US009708141B2

(12) United States Patent
Kishi et al.

(10) Patent No.: US 9,708,141 B2
(45) Date of Patent: Jul. 18, 2017

(54) SHEET TRANSPORT DEVICE AND IMAGE FORMING SYSTEM

(71) Applicant: Konica Minolta, Inc., Chiyoda-ku, Tokyo (JP)

(72) Inventors: Hidehito Kishi, Toyokawa (JP); Riichi Hama, Toyokawa (JP); Ryo Morita, Toyohashi (JP); Naoya Nakayama, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/795,962

(22) Filed: Jul. 10, 2015

(65) Prior Publication Data

US 2016/0009519 A1 Jan. 14, 2016

(30) Foreign Application Priority Data

Jul. 10, 2014 (JP) ..... 2014-142452

(51) Int. Cl.
*B65H 31/30* (2006.01)
*B65H 31/32* (2006.01)
(Continued)

(52) U.S. Cl.
CPC ..... *B65H 1/30* (2013.01); *B65H 29/52* (2013.01); *B65H 31/02* (2013.01);
(Continued)

(58) Field of Classification Search
CPC .... B65H 31/32; B65H 31/3081; B65H 29/34; B65H 29/26
See application file for complete search history.

(56) References Cited

U.S. PATENT DOCUMENTS 6,991,421 B2 * 1/2006 Namba ..... B42C 1/12 270/52.25
7,758,034 B1 * 7/2010 Namba ..... B42B 4/00 270/58.07
(Continued)

FOREIGN PATENT DOCUMENTS

JP 2000327208 A 11/2000
JP 2002128364 A 5/2002

OTHER PUBLICATIONS

Chinese First Office Action corresponding to Patent No. 201510400793.0; Mailing Date: Sep. 5, 2016, with English translation.
(Continued)

*Primary Examiner* — Luis A Gonzalez
(74) *Attorney, Agent, or Firm* — Cantor Colburn LLP

(57) ABSTRACT

Sheet transport device including: first tray having receiving area receiving sheets ejected in first direction; second tray in second direction intersecting first direction with respect to first tray; transporter causing pushing member to move between first and second positions at respective sides of receiving area along second direction, second position closer to second tray than first position, transporter transporting first sheet set to second tray by putting pushing member in contact with end of first sheet set facing first position and causing pushing member to move from first to second position when first sheet set is ejected onto first tray; and direction changer causing guide member to guide, in subsequent second sheet set, at least sheet ejected while pushing member moves across receiving area and to change sheet traveling direction to upward direction over pushing member by putting guide member in predetermined angle with respect to horizontal direction.

10 Claims, 18 Drawing Sheets

(51) Int. Cl.

| | |
|---|---|
| ***B65H 1/30*** | (2006.01) |
| ***B65H 29/52*** | (2006.01) |
| ***B65H 31/02*** | (2006.01) |
| ***B65H 31/38*** | (2006.01) |

(52) U.S. Cl.
CPC ..... *B65H 31/3045* (2013.01); *B65H 31/3081* (2013.01); *B65H 31/32* (2013.01); *B65H 31/38* (2013.01); *B65H 2301/4212* (2013.01); *B65H 2301/4213* (2013.01); *B65H 2404/632* (2013.01); *B65H 2801/27* (2013.01)

(56) References Cited

U.S. PATENT DOCUMENTS

| | | | | |
|---|---|---|---|---|
| 2002/0044810 | A1 | 4/2002 | Sato et al. | |
| 2015/0055200 | A1* | 2/2015 | Hama ..... | H04N 1/00527 358/498 |

OTHER PUBLICATIONS

The State Intellectual Property Office of the People's Republic of China Second Office Action corresponding to Application No. 201510400793.0; Mailing date of May 12, 2017.

* cited by examiner

Sequence before transport of sheet stack to front tray

Sequence after transport of sheet stack to front tray

SHEET TRANSPORT DEVICE AND IMAGE FORMING SYSTEM

CROSS REFERENCE TO RELATED APPLICATIONS

The present invention claims priority under 35 U.S.C. §119 to Japanese Application No. 2014-142452 filed Jul. 10, 2014, the entire content of which is incorporated herein by reference.

BACKGROUND

Technical Field

The present disclosure relates to a sheet transport device and an image forming system that is a combination of the sheet transport device and an image forming device.

Description of Related Art

Conventionally, there exist so-called in-body paper-ejection type image forming devices. An in-body paper-ejection type image forming device is an image forming device (e.g., a copier) that includes an image reader and an image former disposed below the image reader, with a space between the image reader and the image former. In such an in-body paper-ejection type image forming device, the image former forms an image on a sheet, such as a recording sheet, and then ejects the sheet onto an ejection tray that is disposed within the space.

Such an in-body paper-ejection type image forming device is advantageous in that the ejection tray does not protrude sideways from the image forming device. Accordingly, an in-body paper-ejection type image forming device has relatively small size in the lateral direction, which enables installation of an in-body paper-ejection type image forming device at various locations.

Japanese Patent Application Publication No. 2002-128364 (referred to as Patent Literature in the following) discloses an in-body paper-ejection type image forming device having a sheet post-processing device attached within the space (in-body space) between the image reader and the image former. The sheet post-processing device performs post-processing with respect to a sheet ejected from the image reader. The post-processing is, for example, stabling. The sheet post-processing device disclosed in Patent Literature includes a processing tray on which a stack of sheets having images formed thereon is temporarily placed for post processing, and a stack tray on which a post-processed sheet stack transported from the processing tray is placed. The processing tray and the stack tray, when the image forming device is seen from a front side thereof, are arranged next to one another in the lateral direction, with the processing tray to the left and the stack tray to the right. Due to this, the in-body paper-ejection type image forming device disclosed in Patent Literature has relatively great size in the lateral direction. Due to this, despite being an in-body paper-ejection type image forming device, the in-body paper-ejection type image forming device disclosed in Patent Literature does not have reduced size in the lateral direction.

SUMMARY

In view of this, the present inventors have considered a structure where the stack tray is disposed at the front of the image forming device with respect to the processing tray rather than being arranged laterally with respect to the processing tray, and where a pushing member pushes and thereby transports a stack of sheets temporarily placed on the processing tray towards the stack tray when post-processing has been completed. This structure reduces the overall size of the image forming device in the lateral direction. In addition, this structure, in which the stack tray is located close to the front of the image forming device, increases the visibility of sheets on the stack tray and enables a user to retrieve the sheets on the stack tray with ease.

Note that even when post-processing of sheets is not performed, the above-described structure of an in-body paper-ejection type image forming device, where sheets temporarily placed on an internal first tray are transported to a second tray disposed at the front of the device with respect to the first tray, is advantageous for enabling a user to retrieve sheets on the second tray with ease.

Meanwhile, when the stack tray is disposed at the front of the image forming device with respect to the processing tray as described above to reduce the device size in the lateral direction, a stack of sheets transported from the processing tray to the stack tray moves in a direction crossing the direction in which sheets are ejected from the image forming device. Due to this, if the image forming device ejects a sheet onto the processing tray while the stack of sheets is being transported from the processing tray to the stack tray, the ejected sheet may collide with the pushing member transporting the stack of sheets. This may lead to ejection failures such as undesired folding of the ejected sheet and a paper jam caused by the ejected sheet.

Such ejection failures can be avoided by configuring the image forming device to suspend image forming for subsequent sheets, until the transport of the current sheet stack to the stack tray is completed and the pushing member returns to its home position where the pushing member does not interfere with sheet ejection by the image forming device. However, this configuration greatly reduces the productivity of the image forming device.

In view of this, the present disclosure aims to provide a sheet transport device having reduced size in the lateral direction and transporting a recording sheet from a first tray to a second tray without reducing productivity of an image forming device, and an image forming system including the sheet transport device and an image forming device.

In order to achieve this aim, the present disclosure provides, as one aspect thereof, a sheet transport device including: a first tray having a sheet receiving area on which sheets ejected in a first direction from an ejector are placed; a second tray being positioned in a second direction with respect to the first tray, the second direction intersecting the first direction; a transporter configured to cause a pushing member to move back and forth between a first position and a second position each at one side of the sheet receiving area along the second direction, the second position closer to the second tray than the first position, where when a first sheet set composed of a predetermined number of sheets is ejected onto the first tray, the transporter transports the first sheet set to the second tray by putting the pushing member in contact with an end of the first sheet set facing the first position and causing the pushing member to move from the first position to the second position; and a direction changer configured to cause a guide member to guide, in a second sheet set, at least a sheet ejected while the pushing member is moving across the sheet receiving area and to change a direction in which the sheet travels to an upward direction over the pushing member by putting the guide member in a predetermined angle with respect to a horizontal direction, the second sheet set ejected subsequent to the first sheet set and being composed of sheets of the predetermined number. Note that in the present disclosure, the wording "a predetermined number of sheets" does not necessarily refer to a plurality of sheets. That is the predetermined number may be one (1).

Further, the present disclosure provides, as another aspect thereof, an image forming system including an image forming device forming images on sheets and a sheet transport device transporting sheets ejected from the image forming device, where the sheet transport device includes: a first tray having a sheet receiving area on which the sheets ejected in a first direction from the image forming device are placed; a second tray being positioned in a second direction with respect to the first tray, the second direction intersecting the first direction; a transporter configured to cause a pushing member to move back and forth between a first position and a second position each at one side of the sheet receiving area along the second direction, the second position closer to the second tray than the first position, where when a first sheet set composed of a predetermined number of sheets is ejected onto the first tray, the transporter transports the first sheet set to the second tray by putting the pushing member in contact with an end of the first sheet set facing the first position and causing the pushing member to move from the first position to the second position; and a direction changer configured to cause a guide member to guide, in a second sheet set, at least a sheet ejected while the pushing member is moving across the sheet receiving area and to change a direction in which the sheet travels to an upward direction over the pushing member by putting the guide member in a predetermined angle with respect to a horizontal direction, the second sheet set ejected subsequent to the first sheet set and being composed of sheets of the predetermined number.

BRIEF DESCRIPTION OF THE DRAWINGS

These and other objects, advantages and features of the technology pertaining to the present disclosure will become apparent from the following description thereof taken in conjunction with the accompanying drawings, which illustrate a specific embodiment.

In the drawings.

DESCRIPTION OF PREFERRED EMBODIMENTS

The following describes an embodiment of the sheet post-processing device and the image forming system pertaining to the present disclosure, with reference to the drawings.

<Overall Configuration of Image Forming System>

Figure 1:
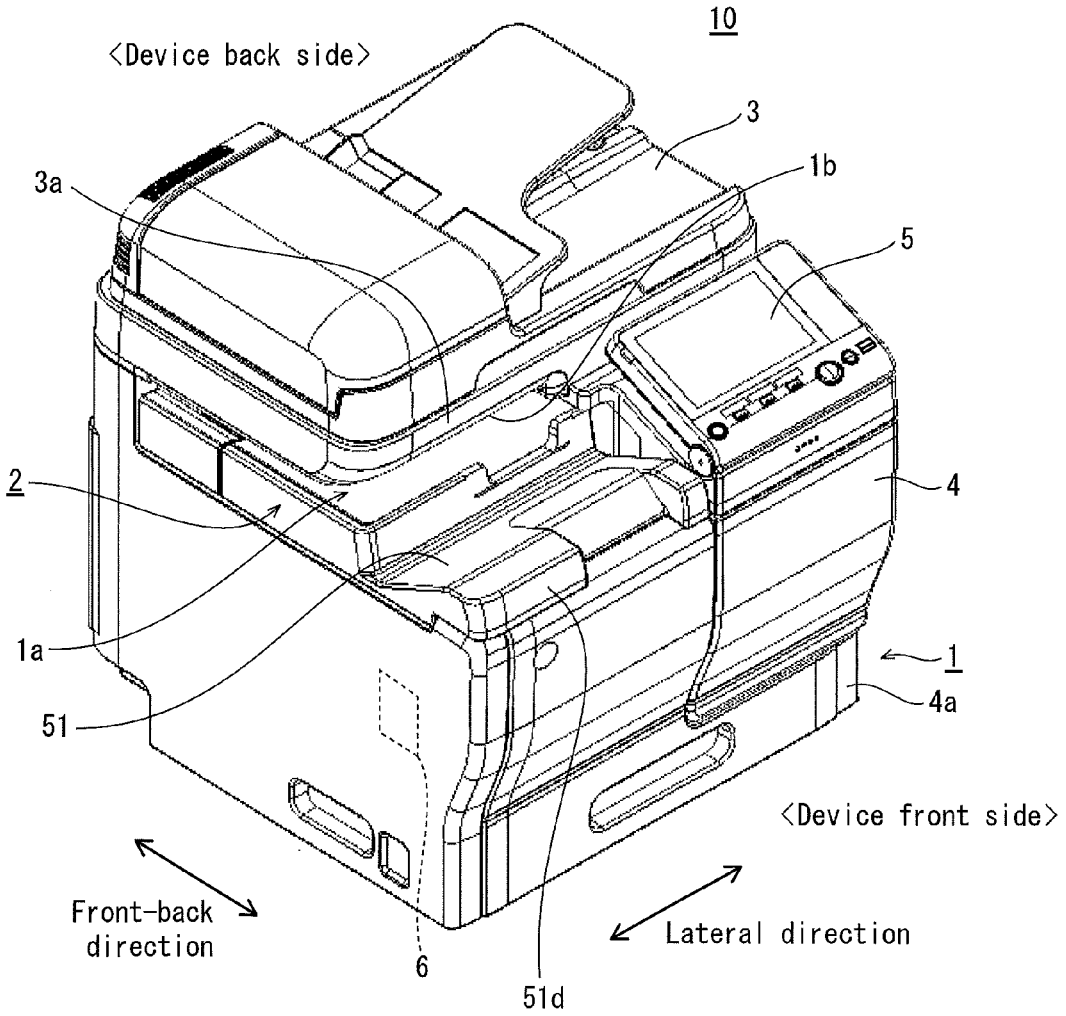
FIG. 1 illustrates an overall configuration of an image forming system including an image forming device and a sheet post-processing device.

FIG. 1 is an external perspective view illustrating the overall configuration of an image forming system 10.

As shown in FIG. 1, the image forming system 10 includes an image forming device 1 and a sheet post-processing device 2 attached to the image forming device 1.

The image forming device 1 includes a scanner 3, a printer 4, an operation unit 5, and a controller 6. The image forming device 1 is an in-body paper-ejection type image forming device, in which the printer 4 is arranged below the scanner 3 with a space 1*a* therebetween. At least a part of the space 1*a* defines an opening 1*b* at the front side of the image forming system 10. The image forming device 1 has functions of executing various types of jobs. Such jobs include a scan job of reading an image of a document, a copy job of printing a document image onto a sheet based on image data obtained through the reading, and a print job of receiving a job request from an external terminal (undepicted) connected to the image forming device 1 via a network, and printing an image pertaining to the received job onto a sheet.

The scanner 3 (image reader) transports a document that is set thereto, and reads an image on the document to obtain image data.

The printer 4 (image former) forms an image (i.e., prints an image) on a sheet, based on the image data obtained by the scanner 3 or data of a print job from an external terminal. The printer 4 performs electrophotographic printing.

The printer 4, during image forming, forms an image on each of sheets that are fed one sheet at a time from a cassette 4*a* located at a lowermost position of the printer 4, and ejects sheets on which images have been formed, one sheet at a time, by using an ejection roller. Sheets ejected from the printer 4 are transported to the sheet post-processing device 2, which is mounted in the space 1*a*.

The printer 4 not necessarily performs electrophotographic printing and may, for example, perform inkjet printing.

The operation unit 5 is located where a user standing in front of the image forming device 1 can operate the operation unit 5 with ease. The operation unit 5 receives input from the user, and notifies the controller 6 of information having been input. The input may be a specification of a number of copies, an instruction to start a job such as copying, an instruction to stop a job, or input related to post-processing at the sheet post-processing device 2. For example, in the present embodiment, input related to post-processing may be an instruction to execute stapling or a specification of a number of copies of stapled documents to be made.

The controller 6 receives the information input by the user from the operation unit 5, and smoothly executes jobs based on user instructions by controlling the scanner 3 and the printer 4. When the input is an instruction to execute post-processing, the controller 6 notifies the sheet post-processing device 2 of the instruction, thereby causing the sheet post-processing device 2 to execute post-processing in accordance with the instruction.

Note that in the present disclosure, the side of the image forming device 1 at which the operation unit 5 is positioned is referred to as a device front side, and a rear side (far side) of the image forming device 1 when viewed from the device front side is referred to as a device back side. A right side of the image forming device 1 when viewed from the device front side is referred to as a device right side, and a left side of the image forming device 1 when viewed from the device front side is referred to as a device left side. Further, a direction connecting the device front side and the device back side is referred to as a device front-back direction and a lateral (left-right) direction perpendicular to the device front-back direction is referred to as a device lateral direction.

Figure 2:
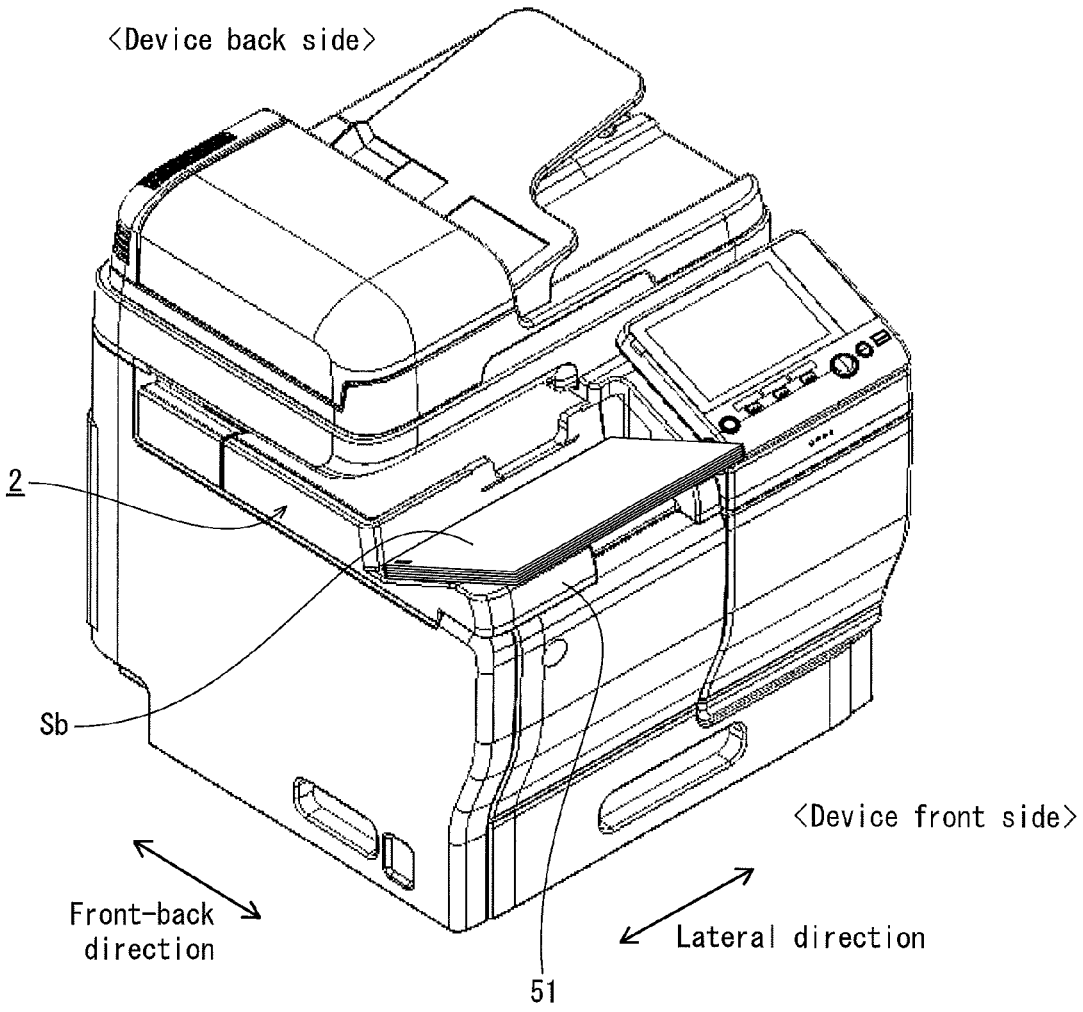
FIG. 2 is a perspective view illustrating a sheet stack placed on a front tray of the sheet post-processing device.

As described above, the sheet post-processing device 2 is positioned in the space 1*a*, at least a part of which defining the opening 1*b* (illustrated in FIG. 1) at the device front side. The sheet post-processing device 2 has a function of stapling together sheets ejected from the printer 4 that compose a sheet stack Sb. Further, the sheet post-processing device 2 holds a stapled sheet stack Sb on a front tray 51 disposed at the device front side thereof, as illustrated in FIG. 2.

<Configuration of Sheet Post-Processing Device>

The following describes the configuration of the sheet post-processing device 2.

Figure 3:
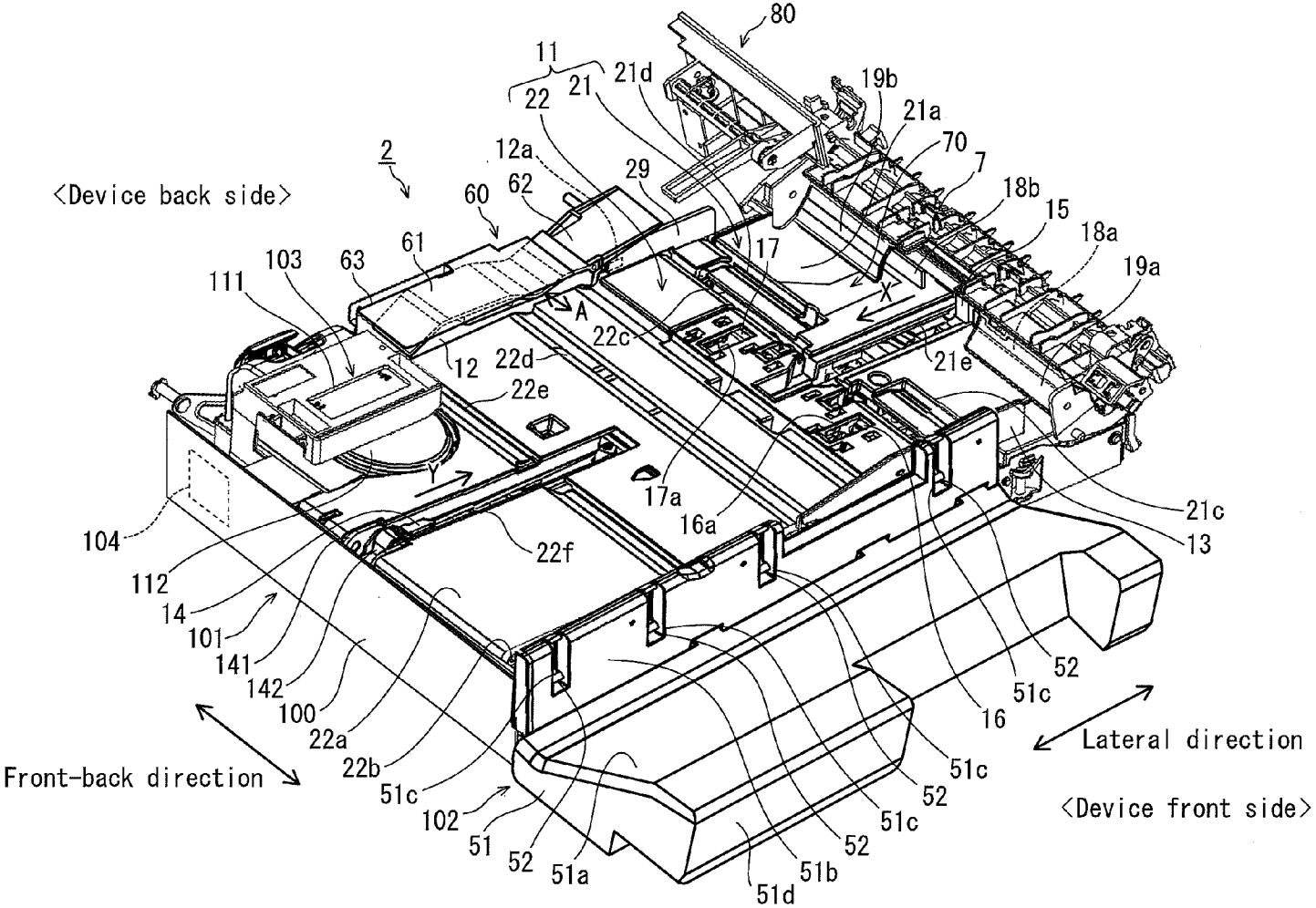
FIG. 3 is a schematic perspective view illustrating the sheet post-processing device, viewed from an obliquely upward point at a device front side.

FIG. 3 is an overall perspective view illustrating the sheet post-processing device 2, viewed from the upper-left front side.

As shown in FIG. 3, the sheet post-processing device 2 includes a first holding portion 101, a second holding portion 102, a stapler 103, and a controller 104.

1. Configuration of First Holding Portion 101

The first holding portion 101 temporarily holds a sheet ejected from the ejection roller of the printer 4 (undepicted in FIG. 3, but is located under a guide member 7). The first holding portion 101 includes a post-processing tray 11, a CD reference plate 12, a CD alignment plate 13, an FD alignment member 14, an FD transport member 15, and guide claws 16, 17.

(1) Post-Processing Tray

The post-processing tray 11 includes a fixed tray 21 and a pivot tray 22. The fixed tray 21 and the pivot tray 22 are arranged in the stated order along a direction in which sheets ejected from the printer 4 are transported (direction indicated by arrow X in FIG. 3). In the following, on or along the post-processing tray 11, the direction indicated by the arrow X is referred to as a sheet transport direction.

The fixed tray 21 is fixed to and supported by a device housing 100 of the sheet post-processing device 2.

The pivot tray 22 is supported by the device housing 100 such that an end portion 22*c* of the pivot tray 22, which is upstream in the sheet transport direction, is pivotable up and down about a pivot shaft 22*b*. The pivot shaft 22*b* is at the other end portion of the pivot tray 22, which is downstream in the sheet transport direction.

FIG. 3 shows the pivot tray 22 in an inclined state, where the end portion 22*c* is at its lowest possible position. When the pivot tray 22 is in the inclined state, a sheet receiving surface 22*a* of the pivot tray 22 and a sheet receiving surface 21*a* of the fixed tray 21 are on the same plane, substantially. Meanwhile, as described in the following, the pivot tray 22 transitions to a horizontal state (illustrated in FIG. 9) by the end portion 22*c* being lifted, when sheets on the pivot tray 22 are transported to the device front side.

The pivoting of the pivot tray 22 is achieved, for example, by a lift mechanism 220 (illustrated in FIG. 11) disposed below the pivot tray 22. The lift mechanism 220 transmits revolution of a lift motor M5 to a gear group 221 that is composed of a plurality of gears and that reduces the number of revolutions. The lift mechanism 220, by transmitting revolution of the lift motor 5 in such a manner, causes a pivot lever 222 fixed to a gear shaft 223 of a most downstream one of the gears in the gear group 221 to pivot in the direction indicated by the arrow illustrated near the pivot lever 222 in FIG. 11. The pivot lever 222 lifts the pivot tray 22 upwards. The mechanism for achieving the pivoting of the pivot tray 22 is not limited in particular to the lift mechanism 220 described above, and may be, for example, a cam mechanism.

Returning to FIG. 3, an upper surface of the fixed tray 21 serves as the sheet receiving surface 21*a*, and an upper surface of the pivot tray 22 serves as the sheet receiving surface 22*a*.

At an end portion of the sheet receiving surface 21*a* that is upstream in the sheet transport direction, two plate-shaped stoppers 18*a*, 18*b* are provided to stand upright. The stoppers 18*a*, 18*b* are disposed along the device front-back direction with an interval therebetween.

The stoppers 18*a*, 18*b* serve as restriction members restricting the position of a rear end of a sheet on the post-processing tray 11 in sheet alignment in the sheet transport direction. In the following, sheet alignment in the sheet transport direction is referred to as FD alignment.

Holding guides 19*a*, 19*b* are located directly above the stoppers 18*a*, 18*b*, respectively. A predetermined interval separates the holding guides 19, 19*b* from the stoppers 18*a*, 18*b*, respectively. The holding guides 19*a*, 19*b* guide a sheet ejected from the ejection roller of the printer 4 onto the fixed tray 21.

A sheet passing the holding guides 19*a*, 19*b* is guided onto the fixed tray 21 and placed on the sheet receiving surface 21*a*. Note that a sheet having a length longer than the length of the fixed tray 21 in the sheet transport direction spans across the sheet receiving surface 21*a* and the sheet receiving surface 22*a*.

(2) CD Reference Plate

The CD reference plate 12 serves as a position determining member that determines a reference position of a sheet on the post-processing tray 11 in sheet alignment in the device front-back direction. The CD reference plate 12 is perpendicular to the sheet receiving surface 22*a* and parallel to the sheet transport direction. The CD reference plate 12 is supported to be movable in the device front-back direction along two grooves 22*d*, 22*e* provided to the sheet receiving surface 22*a*. The grooves 22*d*, 22*e* are elongated in the device front-back direction and separated by an interval in the sheet transport direction. In the following, sheet alignment in the device front-back direction is referred to as CD alignment.

FIG. 3 illustrates the CD reference plate 12 positioned at its home position, which is a position of the CD reference plate 12 closest to the device back side. During CD alignment, the CD reference plate 12 stops after moving by a predetermined distance from its home position (for example, 10 mm) towards the device front side. This stationary position is the reference position for CD alignment. This reference position also serves as a reference stapling position in the device front-back direction when the stapler 103 performs the stapling.

Further, due to being movable to a position closest to the device front side as described in the following, the CD reference plate 12 also serves as a transporting member that transports a sheet on the post-processing tray 11 to a front tray 51 (second tray) of the second holding portion 102. Movement of the CD reference plate 12 is achieved by drive force of a transport motor M4 (illustrated in FIG. 15). For example, the CD reference plate 12 may be connected to a rotary shaft of the transport motor M4 via a rotation wire (not illustrated) tensioned between at least two pulleys. With such a structure, movement of the CD reference plate 12 (wire drive) is achieved by the rotation wire being rotated by the drive force from the transport motor M4 and the drive force being transmitted to the CD reference plate 12.

Note that movement of the CD reference plate 12 is not limited to being achieved by wire drive as described above, and may, for example, be achieved by a screw feed mechanism causing linear movement of the CD reference plate 12. Each of the CD alignment plate 12, the FD alignment member 14, and the FD transport member 15, which are described in the following, may also adopt a movement mechanism similar to that of the CD reference plate 12.

A CD reference plate 29 is disposed at an end portion of the fixed tray 21 at the device back side. Specifically, the CD reference plate 29 is disposed facing the CD alignment plate 13 and at a position further upstream in the sheet transport direction than the CD reference plate 12.

The CD reference plate 29 has a CD alignment function, similar to the CD reference plate 12. The CD reference plate 29 is perpendicular to the sheet receiving surface 21*a* and parallel to the sheet transport direction. The CD reference plate 29 is supported to be movable in the device front-back direction along a groove 21*d* in the sheet receiving surface 21*a*. The groove 21*d* is elongated in the device front-back direction.

The CD reference plate 29 is connected to a portion of the device housing 100 via a tension spring undepicted in the drawings. Due to the tension spring exerting a biasing force towards the device back side onto the CD reference plate 29, a surface 29*a* of the CD reference plate 29 at the device back side is always in contact with a protrusion 12*a* provided to an end portion of the CD reference plate 12 that is upstream in the sheet transport direction.

Accordingly, when the CD reference plate 12 moves towards the device front side, force towards the device front side is transferred to the CD reference plate 29 via the protrusion 12*a*. Thus, the CD reference plate 29 moves towards the device front side together with the CD reference plate 12, overcoming the biasing force of the tension spring.

Meanwhile, when the CD reference plate 12 moves towards the device back side, the CD reference plate 29 also move towards the device back side due to the biasing force of the tension spring. In this movement, the contact between the CD reference plate 29 and the protrusion 12*a* is maintained. As such, the CD reference plate 12 is an active CD reference plate and the CD reference plate 29 is a passive CD reference plate, with movement of the CD reference plate 12 driving the CD reference plate 29 move.

The CD reference plate 29 is positionally restricted so as not to move further towards the device back side than its home position. Engagement between the CD reference plate 29 and the protrusion 12*a* is released when the pivot tray 22 transitions to its horizontal state (illustrated in FIG. 11) as described in the following, and the CD reference plate 29 returns to its home position due to the biasing force of the tension spring.

(3) CD Alignment Plate

The CD alignment plate 13 is a member for CD alignment of a sheet on the post-processing tray 11. The CD alignment plate 13 is perpendicular to the sheet receiving surface 21*a* and parallel to the sheet transport direction. The CD alignment plate 13 is supported to be movable in the device front-back direction along a groove 21*c* in the sheet receiving surface 21*a*. The groove 21*c* is elongated in the device front-back direction. FIG. 3 illustrates the CD alignment plate 13 positioned at its home position, which is a position of the CD alignment plate 13 closest to the device front side. Movement of the CD alignment plate 13 is achieved by drive force of a CD alignment motor M2 (illustrated in FIG. 15).

(4) FD Transport Member

The FD transport member 15 serves as a contact member that moves a sheet on the post-processing tray 11 in the sheet transport direction. The FD transport member 15 is supported so as to be movable along a groove 21*e* in the stacking surface 21*a*, with an upper end portion of the FD transport member 15 protruding from the groove 21*e*. The groove 21*e* is elongated in the sheet transport direction.

FIG. 3 illustrates the FD transport member 15 positioned at its home position, which is a position of the FD transport member 15 that is most upstream in the sheet transport direction. At its home position, the FD transport member 15 is slightly further upstream in the sheet transport direction than the stoppers 18*a*, 18*b*. Movement of the FD transport member 15 is achieved by drive force of a transport motor M1 (illustrated in FIG. 7).

(5) FD Alignment Member

The FD alignment member 14 is used for FD alignment of a sheet on the post-processing tray 11. The FD alignment member 14 is supported to be movable back and forth along a groove 22*f* provided in the sheet receiving surface 22*a*. The groove 22*f* is elongated in the sheet transport direction.

In FIG. 3, the FD alignment member 14 is at its home position. At its home position, the FD alignment member 14 is in contact with guide plates 141, 142, and is therefore in a submerged state (retracted state) of being retracted into the groove 22*f* of the pivot tray 22. Meanwhile, when the FD alignment member 14 is positioned upstream in the sheet transport direction than its home position due to having moved from its home position in a direction opposite to the sheet transport direction (direction indicated by arrow Y), the FD alignment member 14 is in a protruding state where an upper end portion thereof protrudes from the groove 22*f* (illustrated in FIG. 4). The FD alignment member 14 switches to the protruding state due to biasing force exerted thereon by a biasing member such as a torsion spring. Movement of the FD alignment member 14 is achieved by drive force of an FD alignment motor M3 (illustrated in FIG. 15).

(6) Guide Claws

The guide claws 16, 17 are respectively located within openings 16*a*, 17*a*. The openings 16*a*, 17*a* are provided in the sheet receiving surface 22*a* near the end portion 22*c*, which is the end portion of the pivot tray 22 upstream in the sheet transport direction. The guide claws 16, 17 are supported by the pivot tray 22 to be switchable between a retracted state (illustrated in FIG. 3) retracting inside the openings 16*a*, 17*a*, respectively, and a protruding state (illustrated in FIG. 6) of protruding from the openings 16*a*, 17*a*, respectively.

Switching of the guide claws 16, 17 between the retracted state and the protruding state is, for example, achieved by drive force of a guide claw drive actuator 36 (illustrated in FIG. 15) composed of a solenoid. Here, when the guide claw drive actuator 36 is driven, the guide claws 16, 17 are put in protruding state, and when the driving of the guide claw drive actuator 36 is stopped, the guide claws 16, 17 return to the retracted state due to biasing force exerted onto the guide claws 16, 17 by tension springs (undepicted).

2. Configuration of Stapler 103

The stapler 103 is located at the device back side of the pivot tray 22, at an end portion of the pivot tray that is downstream in the sheet transport direction. The stapler 103 includes a stapling unit 111 and a staple receiving unit 112 separated by an interval in a vertical direction.

The stapler 103 performs stapling by, with a corner portion of a sheet stack Sb on the pivot tray 22 between the stapling unit 111 and the staple receiving unit 112, causing the stapling unit 111 to lower towards the staple receiving unit 112 so that the corner portion is sandwiched between the stapling unit 111 and the staple receiving unit 112. Further, the stapler 103 causes the stapling unit 111 to staple the sheet stack Sb with a bottom portion of the stapling unit 111 pressed against a topmost sheet of the sheet stack Sb. The corner portion of the sheet stack Sb is a portion at the device back side of a leading end of the sheet stack Sb in the sheet transport direction.

A sheet stack Sb stapled by the stapler 103 is then transported to a position for transport from the first holding portion 101 to the second holding portion 102 (the position referred to in the following as a transport position).

3. Moveable Guides

As described in the following, when the sheet stack Sb is transported to the transport position, the pivot tray 22 pivots and transitions to the horizontal state, and the CD reference plate 12 pushes the sheet stack Sb towards the front tray 51. Here, it should be noted that without the configuration described in the following, if a sheet of a subsequent sheet set is ejected to the sheet post-processing device 2 by the image forming device 1, the sheet of the subsequent sheet set may collide with the upstream end portion of the pivot tray 22 in the horizontal state or with the CD reference plate 12 moving to push the sheet stack Sb towards the front tray 51. Accordingly, the sheet of the subsequent sheet set may be folded undesirably, or may cause a paper jam (i.e., ejection failures may occur). In order to prevent such ejection failures, the printing by the image forming device 1 would need to be suspended temporarily, which greatly reduces productivity of the image forming device 1.

In view of this, the present embodiment provides two types of movable guide parts, namely, a first guide unit 60 and a second guide unit 70. The first guide unit 60 and the second guide unit 70 enable ejection of a sheet of a subsequent sheet set to the post-processing tray 11 to be performed without bringing about ejection failures and without having to suspend printing by the image forming device 1.

(1) First Guide Part (Supporting Member)

The first guide unit 60 is included in the sheet post-processing device 2, and is located at the device back side of the pivot tray 22.

The first guide unit 60 is composed of a guide plate main body 61, a pivot guide plate 62, and an actuator 63. The pivot guide plate 62 is pivotably supported by a pivot shaft 623 (illustrated in FIG. 4) at an end portion of the guide plate main body 61 that is upstream in the sheet transport direction (i.e., the direction indicated by arrow X in FIG. 3). The actuator 63 causes the guide plate main body 61 to move in a direction (the direction indicated by arrow A in FIG. 3) intersecting the sheet transport direction.

The actuator 63 causes the guide plate main body 61 and the pivot guide plate 62 to move back and forth between a home position and a guide position. In FIG. 3, the guide plate main body 61 and the pivot guide plate 62 are located at the home position. At the home position, the guide plate main body 61 and the pivot guide plate 62 are at the device back side of the sheet post-processing device 2. In plan view of the sheet post-processing device 2, when located at the home position, the guide plate main body 61 and the pivot guide plate 62 do not overlap with the sheet receiving surface 22*a*. Meanwhile, in FIG. 5, the guide plate main body 61 and the pivot guide plate 62 are located at the guide position. To reach the guide position, the guide plate main body 61 and the pivot guide plate 62 move towards the device front side from the home position. Further, when located at the guide position, the guide plate main body 61 and the pivot guide plate 62 overlap with a device-back-side portion of the sheet receiving surface 22*a*, and guide sheets ejected from the image forming device 1.

The actuator 63 may be implemented by using any means, such as a solenoid, a screw feed mechanism, or a cam mechanism, as long as the actuator 63 is capable of causing the guide plate main body 61 to move back and forth in the direction indicated by arrow A.

The guide plate main body 61 is located at the guide position when the pivot tray 22 is in the inclined state and thus, the sheet receiving surface 22*a* and the sheet receiving surface 21*a* are on the same place, substantially.

Figure 5:
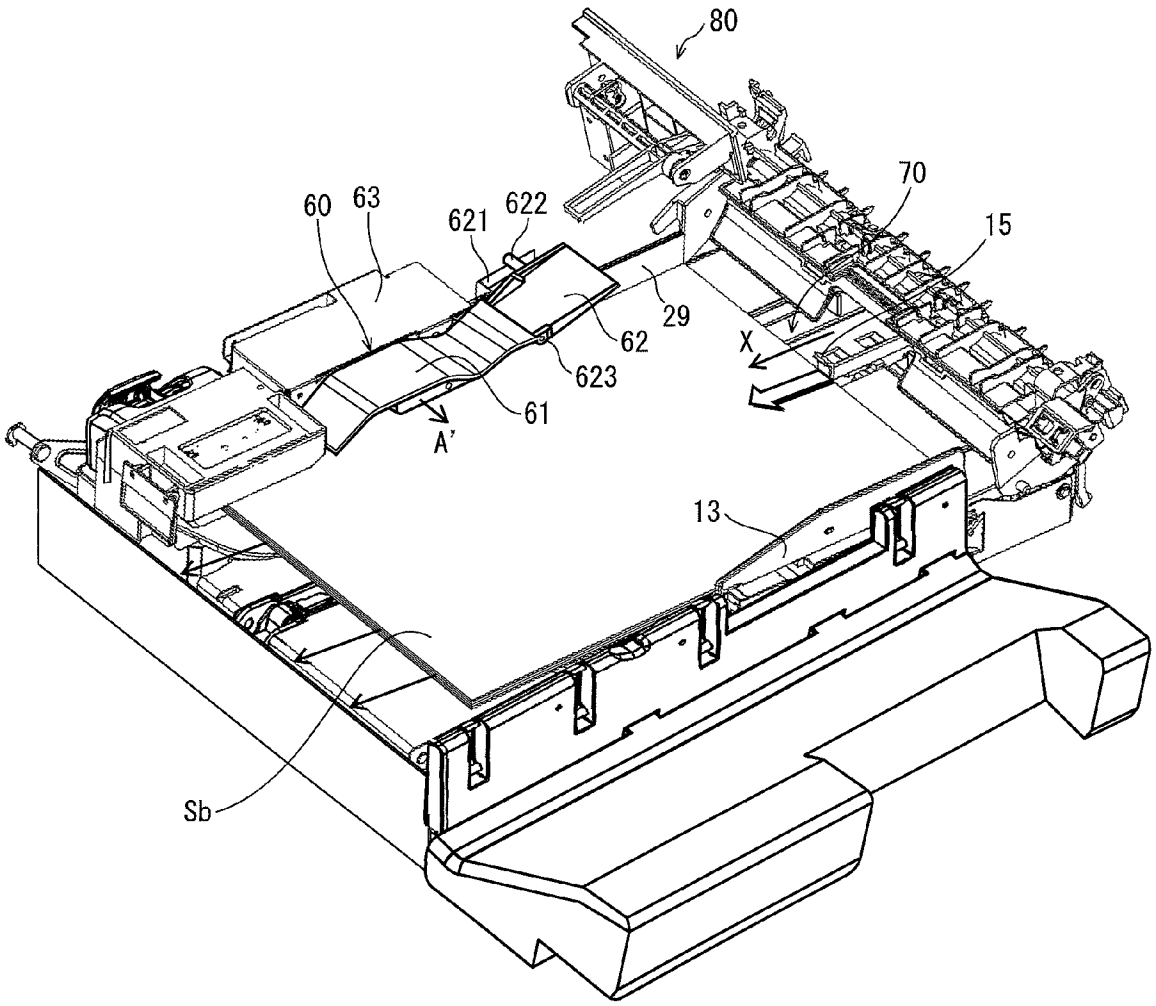
FIG. 5 is a schematic perspective view illustrating transport of an aligned sheet stack to a stapling position.

As illustrated in FIG. 5, an engagement pin 622 is provided on a lateral end portion of the pivot guide plate 62 at the device rear side. The engagement pin 622 engages with an upper end of an engagement member 621 that is fixed to a frame 100 of the sheet post-processing device 2 when the pivot tray 22 is in the inclined state. When the pivot tray 22 is in the inclined state, this structure keeps a front end of the pivot guide plate 62 in a state of being directed away from the sheet receiving surfaces 21*a* and 22*a*, and guides a sheet ejected from the image forming device 1 to the sheet receiving surfaces 21*a* and 22*a*, which are below the guide plate main body 61.

Figure 9:
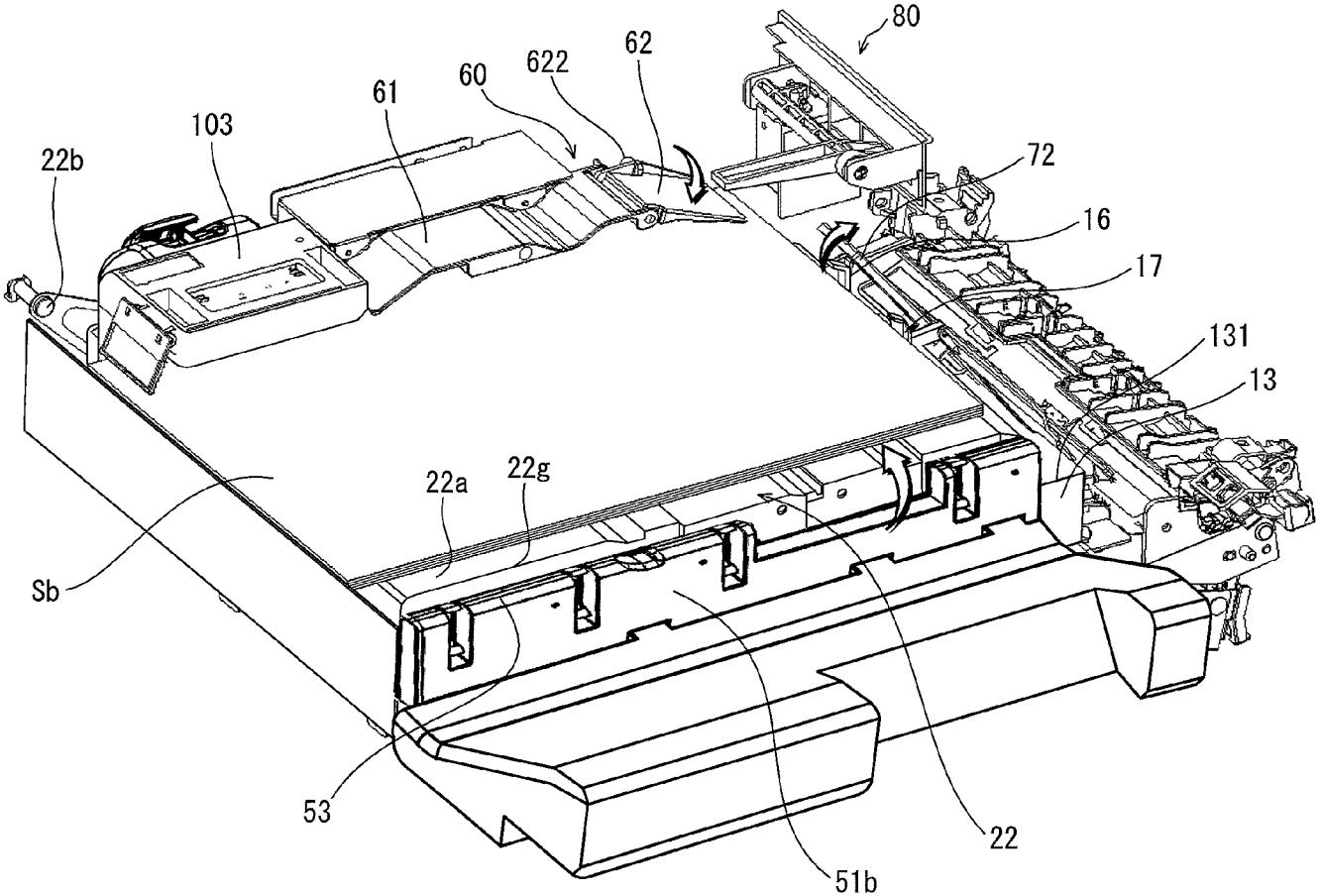
FIG. 9 is a schematic perspective view illustrating the pivot tray after transition to a horizontal state.

Meanwhile, when the pivot tray 22 is lifted and transitions to the horizontal state after the stapling, the first guide unit 60 rises together with the pivot tray 22. Accordingly, as illustrated in FIG. 9, the relative distance between the pivot shaft 623 and the engagement member 621 increases, which causes the front end of the pivot guide plate 62 to automatically become lower than the guide plate main body 61.

(2) Second Guide Unit 70

Initially, the second guide unit 70 is retracted below the sheet receiving surface 21*a* (illustrated in FIGS. 3 and 4).

However, the movement of the FD transport member 15 for transporting a sheet stack Sb towards the pivot tray 22 causes guide members (guide base part 71, slide guide plate 72) included in the second guide unit 70 to spring up. The guide members of the second guide unit 70, in sprung-up state (illustrated in FIG. 7B), guide a sheet S ejected from the image forming device 1 upwards.

Figure 7A:
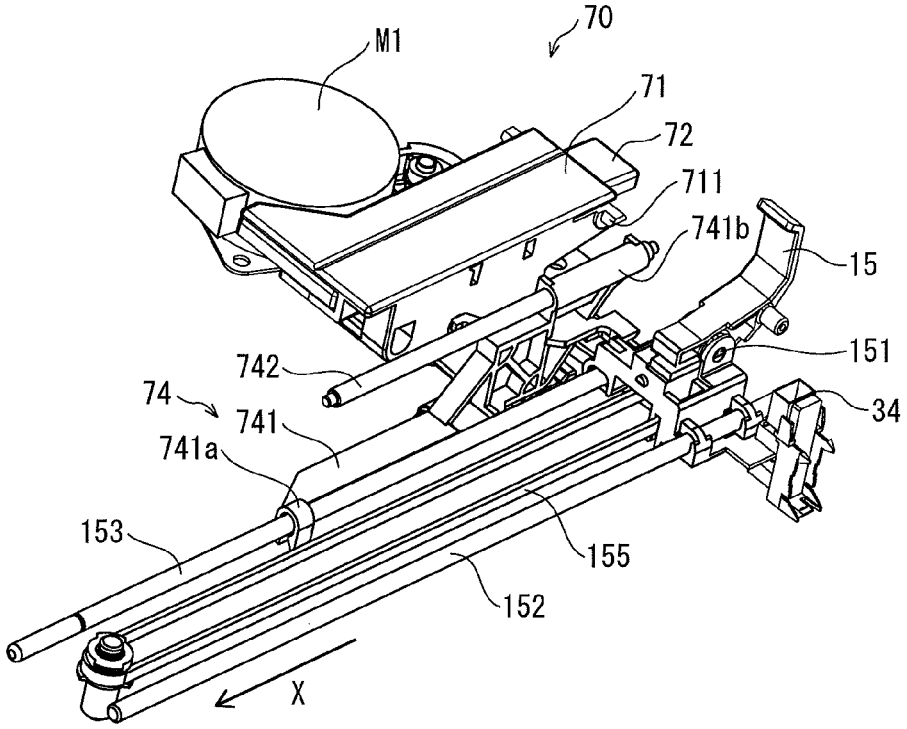
FIG. 7A illustrates a retracted state of a guide part of a second guide part.
Figure 7B:
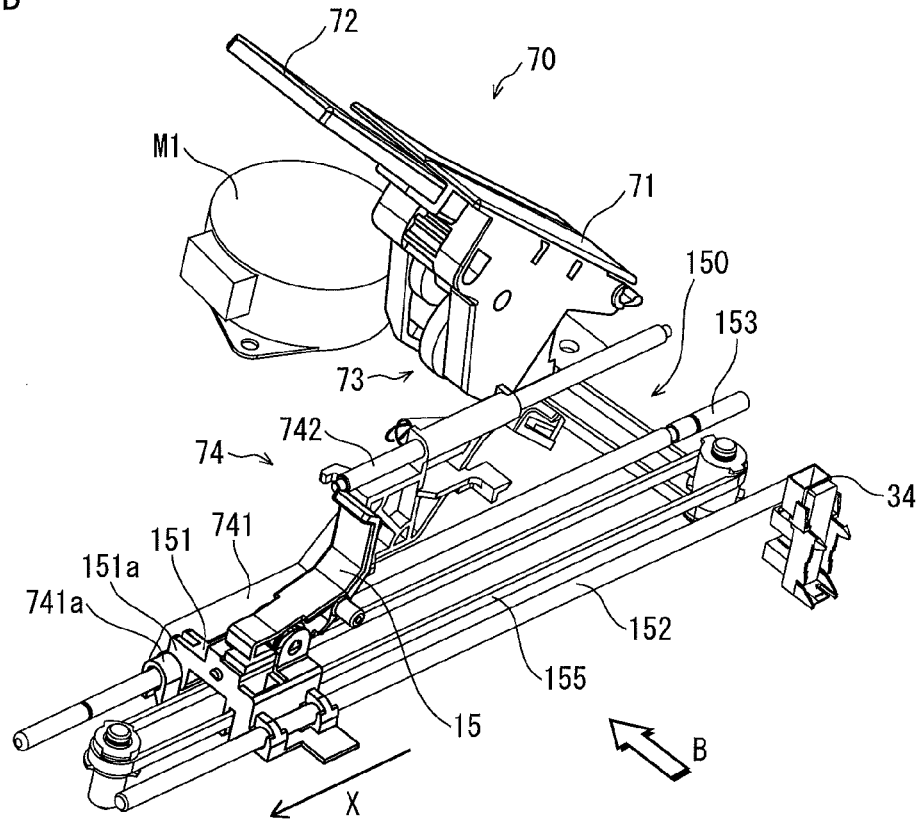
FIG. 7B illustrates a sprung-up state of the guide part of the second guide part.

FIGS. 7A and 7B are schematic perspective views illustrating the structure of a drive mechanism of the second guide unit 70 and the FD transport member 15. Specifically, FIG. 7A illustrates the second guide unit 70 in normal state where a guide surface of the second guide unit 70 and the sheet receiving surface 21*a* are on the same plane, and FIG. 7B illustrates the second guide unit 70 when the guide members of the second guide unit 70 are in sprung-up state.

FIG. 7A illustrates the FD transport member 15 at its home position. A base 151 of the FD transport member 15 is slidably supported by two guide rails, namely guide rails 152, 153 that are disposed in parallel with the sheet transport direction. Further, rotation of a belt 155 included in a belt drive mechanism 150 causes the base 151 to move in the sheet transport direction (illustrated in FIG. 7B). The belt drive mechanism 150 includes a plurality of pulleys and the belt 155, which is tensioned between the pulleys, and is driven by a motor M1. Each of the guide rails 152, 153 is fixed to a frame of the post-processing tray 11 by both end portions thereof being fixed to the frame via undepicted support members.

The second guide unit 70 is composed of the guide base part 71, the slide guide plate 72, a guide extension mechanism 73 (illustrated in FIGS. 7B and 8B), and a guide base part pivot mechanism 74.

The slide guide plate 72 is supported by the guide base part 71 to be slidable in a guide direction. When the guide base part pivot mechanism 74 causes the guide base part 71 to pivot and spring up, the pivoting of the guide base part 71 causes the guide extension mechanism 73 to cause the slide guide plate 72 to project forward.

The guide base part pivot mechanism 74 includes a cam member 741 and a guide rail 742. The guide rail 742 is disposed above the guide rail 153, in parallel with the guide rail 153.

The cam member 741 has a ring portion 741*a* and a sleeve portion 741*b*. The ring portion 741*a* is disposed at an end portion of the cam member 741 that is downstream in the X direction. The sleeve portion 741*b* is disposed at an end portion of the cam member 741 that is upstream in the X direction. The ring portion 741*a* has the guide rail 153 inserted therein, and the sleeve portion 741*b* has the guide rail 742 inserted therein. Accordingly, the cam member 741 is supported by the guide rails 153, 742 to be slidably movable in the X direction.

Note that similar to the guide rails 152, 153, the guide rail 742 is fixed to the frame 100 via undepicted support members.

Movement of the FD transport member 15 in the X direction by a predetermined distance, for transporting a sheet stack Sb to a stapling position, causes the cam member 741 to move in the X direction, due to a front end portion 151*a* of the base 151 coming in contact with the ring portion 741*a*.

Figure 8A:
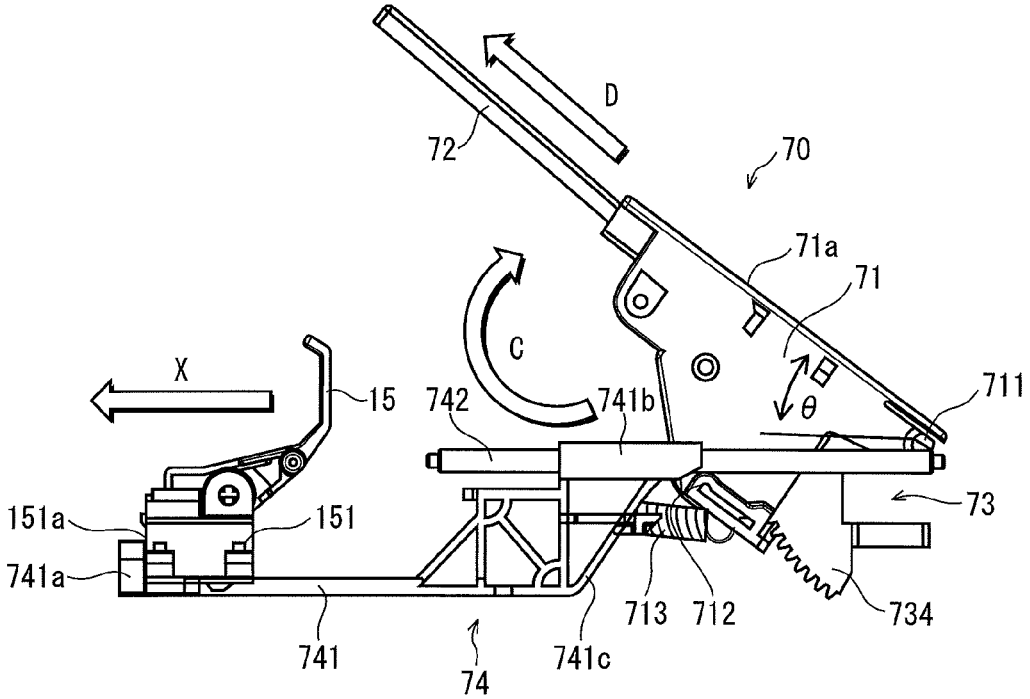
FIG. 8A illustrates a structure where movement of the FD transport member in an X direction causes a guide base part of the second guide part to spring up.

FIG. 8A is a lateral view from the direction indicated by arrow B in FIG. 7B. Note that for the sake of explanation, FIG. 8A does not illustrate components such as the guide rails 152, 153.

The guide base part 71 of the second guide unit 70 is pivotably supported by the fixed tray 21 via the pivot shaft 711. Specifically, a tension spring 713 connecting a lower end portion of the guide base part 71 and the cam member 741 biases the guide base part 71 to pivot upwards.

The inclined state of the pivoting guide base part 71 is dependent upon the state of engagement between an engagement member 712 disposed at the lower end portion of the guide base part 71 and an inclined guide end portion 741*c* of the cam member 741.

Specifically, when the cam member 741 is at its home position (illustrated in FIG. 7A), the engagement member 712 engages with a lower part of the inclined guide end portion 741*c*. As such, a guide surface 71*a* of the guide base part 71 and the sheet receiving surface 21*a* are on the same plane, substantially.

Meanwhile, when the FD transport member 15 starts to move in the X direction and the front end portion 151*a* of the base 151 comes in contact with the ring member 741*a*, the cam member 741 also moves in the X direction accompanying the FD transport member 15. Accordingly, the point of engagement between the engagement member 712 and the inclined guide end portion 741*c* approaches the guide rail 742, which causes the guide base part 71 to pivot upwards. Further, when the engagement member 712 comes in contact with the guide rail 742, the guide base part 71 stops pivoting at a maximum elevation angle θ.

When the FD transport member 15 returns to its home position, the cam member 741 also returns to its original position due to the biasing force of the tension spring 713. Further, the point of engagement between the engagement member 712 and the inclined guide end portion 741*c* lowers, and the guide base part 71 returns to its initial retracted position.

Figure 8B:
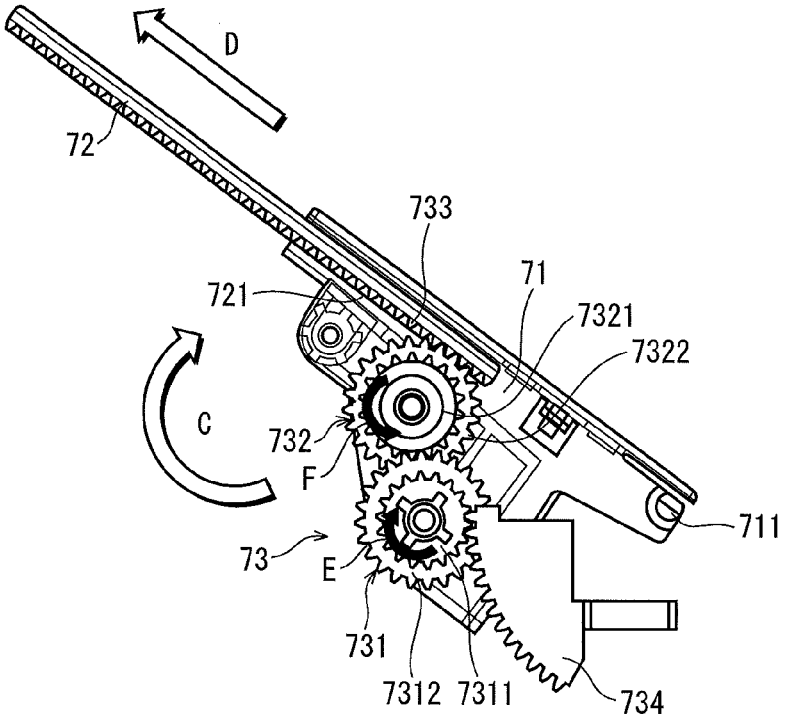
FIG. 8B is a schematic cross-sectional view illustrating a structure where springing-up of the guide base part causes a slide guide plate to project forward.

FIG. 8B is an internal perspective view illustrating the structure of the guide extension mechanism 73, which causes the slide guide plate 72 to project forward when the guide base part 71 pivots upwards.

The guide extension mechanism 73 includes two double gears 731 and 732 that are each rotatably supported by a corresponding shaft.

A small gear 7311 of the double gear 731 engages with a partial spur gear 734 fixed to the fixed tray 21. A large gear 7312 of the double gear 731 engages with a small gear 7321 of the double gear 732. A large gear 7322 of the double gear 732 engages with the teeth of a rack provided on a bottom surface of the slide guide plate 72. The large gear 7322 and the rack form a rack and pinion mechanism.

The partial spur gear 734 is disposed such that the virtual axis thereof is at the same position as the axis of the pivot shaft 711. Thus, when the guide base part pivot mechanism 74 causes the guide base part 71 to start to pivot upwards, the double gear 731 rotates in the direction indicated by arrow E. This rotation of the double gear 731 causes the double gear 732 to rotate in the direction indicated by arrow F, which results in the rack and pinion mechanism causing the slide guide plate 72 to project forward (i.e., the direction indicated by arrow D).

The partial spur gear 734 and the double gears 731, 732 are put in engagement such that the number of rotations increases in the order of the double gear 731 and the double gear 732. Thus, a slight pivot of the guide base part 71 results in the slide guide plate 72 extending to an extent sufficient to guide sheets to a later-described position.

When the FD transport member 15 returns to its home position and the guide base part 71 returns to its initial retracted position, the slide guide plate 72 returns to the inside of the guide base part 71. The movement of the slide guide plate 72 when returning to the inside of the guide base part 71 is the opposite of the movement described above (i.e., the movement when the slide guide plate 72 projects forward from the guide base part 71).

FIG. 3 illustrates a pressing guide member 80. The pressing guide member 80 prevents a sheet S2 (a sheet guided upward by the second guide unit 70 after being ejected) from traveling any further upward in the vertical direction. Further, the pressing guide member 80 presses down on the sheet S2 on an upper guide surface of the first guide unit 60, so that the sheet S2 is sandwiched between the pressing guide member 80 and the upper guide surface of the first guide unit 60. This prevents, as much as possible, a portion of the sheet S2 in the device front side that is not supported by the first guide unit 60 from hanging down from the first guide unit 60 and coming in contact with an upper end of the CD reference plate 12 moving for sheet transportation. Further, even if the above-described portion of the sheet S2 unfortunately does come in contact with the upper end of the CD reference plate 12, the pressing guide member 80 prevents the sheet S2 from moving along with the CD reference plate 12. Without the pressing guide member 80, the sheet S2 may move along with the CD reference plate 12 due to friction between the sheet S2 and the upper end of the CD reference plate 12. The pressing guide member 80 is described in further detail later in the present disclosure.

4. Configuration of Second Holding Portion 102

Returning to FIG. 3, the second holding portion 102 includes the front tray 51 and four pressing claws 52.

(1) Front Tray

The front tray 51 (second tray) closer to the device front side than the post-processing tray 11, and receives sheets transported from the post-processing tray 11 towards the device front side.

The front tray 51 has a sheet receiving surface 51*a* that inclines downwards with an end portion in the device back side lower than an end portion in the device front side, and an upright wall portion 51*b* that stands upright in the vertical direction at the end portion of the sheet receiving surface 51*a* in the device back side.

When viewing the image forming apparatus 1 with the sheet post-processing device 2 mounted therein from the device front side, the front tray 51 and the operation unit 5 are next to one another in the device lateral direction as illustrated in FIG. 1, and the end portion of the front tray 51 in the device front side (end portion 51*d*) is closer in the device front-back direction to the device front side than an end portion 3*a* of the scanner 3 in the device front side.

Further, as shown in FIG. 3, the length of the front tray 51 in the device lateral direction is approximately the same as the length of the pivot tray 22 in the device lateral direction.

(2) Pressing Claws

The four pressing claws 52 are each located inside a corresponding one of four cutout portions 51*c* provided in the upright wall portion 51*b*. The cutout portions 51*c* are disposed along the device lateral direction with intervals therebetween. Each pressing claw 52 is supported to be switchable between a retracted position illustrated in FIG. 3 and a protruding position of protruding from the upright wall portion 51*b* illustrated in FIG. 12. The protruding position of the pressing claws 52 is described later in the present disclosure. The pressing claws 52, when in the protruding position, press on and hold sheets on the front tray 51 so that the sheets do not rise.

<Operation of Sheet Post-Processing Device>

The following describes in detail the operations of the components of the sheet post-processing device 2, whose basic configuration has been described above. In specific, the following describes the operations up to the point when an N number of sheets S ejected from the image forming device 1 are transported to the front tray 51 after being stapled. In the present embodiment, N is no smaller than two and indicates the number of sheets S making up one sheet stack Sb (a sheet set), or in other words, the number of sheets S that are stapled together in one stapling operation.

1. Alignment

When a first sheet is ejected by the image forming device 1 and transported to the sheet post-processing device 2, the first sheet is guided to the post-processing tray 11 via the holding guides 19*a*, 19*b*. The first sheet is transported in the sheet transport direction on the post-processing tray 11 by the drive power of the ejection roller until a rear end of the first sheet in the sheet transport direction passes through the ejection roller of the printer 4. Accordingly, the first sheet is placed on a sheet receiving surface of the post-processing tray 11.

Figure 4:
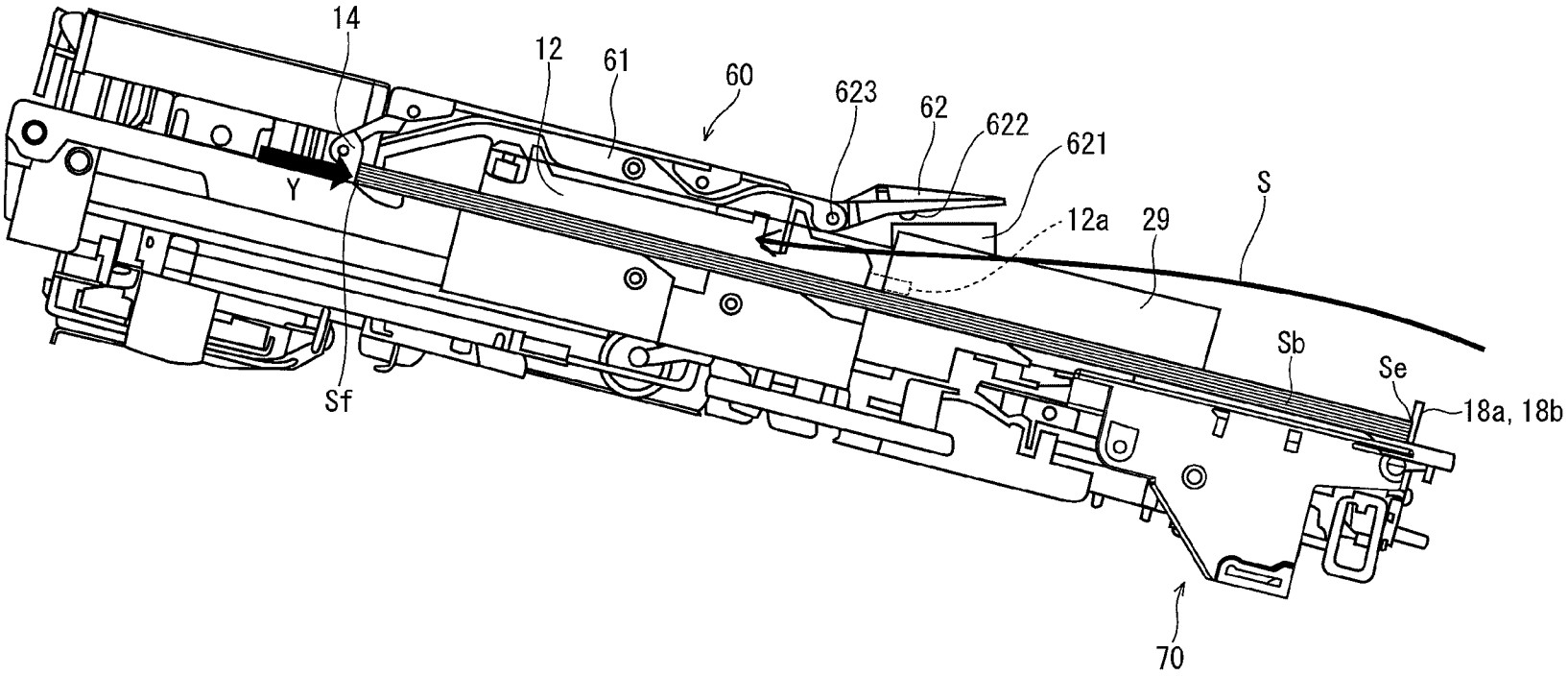
FIG. 4 is a schematic cross-sectional view illustrating a path of sheet ejection in an inclined state of a pivot tray and FD alignment by an FD alignment member.

FIG. 4 is a schematic cross-sectional view of the post-processing tray 11 illustrating ejection of a sheet S onto the post-processing tray 11.

A sheet S ejected from the image forming device 1 is guided by the guide plate main body 61 and the pivot guide plate 62 to be placed on the post-processing tray 11. Here, the pivot guide plate 62 is in a state of being inclined relatively upwards, due to the engagement between the engagement member 621 and the engagement pin 622.

Prior to the sheet S being placed on the post-processing tray 11, the CD reference plates 12, 29 arrive at their reference positions from their home positions. Then, when the sheet S has been placed on the post-processing tray 11, the FD alignment member 14 moves in the direction indicated by arrow Y in FIG. 3 from its home position to arrive at an FD alignment position for performing FD alignment. The FD alignment position differs depending upon the sheet size of the sheet S.

The FD alignment position is separated from the stoppers 18*a*, 18*b* by a sheet length L of the sheet S, which is the length of the sheet S in the sheet transport direction, and is set by acquiring sheet information indicating the sheet size (A4, etc.) and a transport orientation (longitudinal or transverse) of the sheet S from the image forming device 1.

A longitudinal transport orientation of the sheet S is an orientation in which the sheet S is transported while, among long edges and short edges of the sheet S, the long edges are oriented along the sheet transport direction (longitudinal paper feed), and a transverse transport orientation of the sheet S is an orientation in which the sheet S is transported while the short edges are oriented along the sheet transport direction (transverse paper feed).

Here, an upstream side of the post-processing tray 11 in the sheet transport direction is lower than a downstream side of the post-processing tray 11 in the transport direction. Thus, the sheet S ejected onto the post-processing tray 11 slides towards the stoppers 18*a*, 18*b* on the sheet receiving surface of the post-processing tray 11. Further, movement of the FD alignment member 14 to the FD alignment position pushes the sheet S in the direction indicated by arrow Y on the post-processing tray 11, causing a rear end Se of the sheet S in the sheet transport direction to come in contact with the stoppers 18*a*, 18*b* while a leading end Sf of the sheet S in the sheet transport direction is in contact with the FD alignment member 14.

In this way, the sheet S on the post-processing tray 11 is aligned in the sheet transport direction, with the position of the stoppers 18*a*, 18*b* used as a reference.

When the FD alignment is completed, the CD alignment plate 13 moves towards the device back side from its home position illustrated in FIG. 3 to arrive at a CD alignment position. The CD alignment position differs depending upon the sheet size of the sheet S, and is a position at which the CD alignment plate 13 performs CD alignment.

The CD alignment position is separated from the CD reference plate 12 by a sheet width W of the sheet S, which is the length of the sheet S in the device front-back direction, and is set by acquiring the sheet information from the image forming device 1.

The movement of the CD alignment plate 13 to the CD alignment position causes a side edge of the sheet S farther from the CD alignment plate 13 to come in contact with the CD reference plates 12, 29. In this way, the sheet S is aligned in the device front-back direction on the post-processing tray 11, with the position of the CD reference plates 12, 29 used as a reference.

When the FD alignment of the first sheet S is completed, the FD alignment member 14 retreats from the FD alignment position to a position a predetermined distance (for example, 10 mm) away from the FD alignment position and remains at the position until a second sheet S is transported onto the post-processing tray 11 from the image forming device 1. Similarly, when the CD alignment is completed, the CD alignment plate 13 retreats from the CD alignment position to a position a predetermined distance (for example, 10 mm) away from the CD alignment position, and remains at the position until the second sheet S is transported onto the post-processing tray 11 from the image forming device 1.

When the second sheet S is transported onto the post-processing tray 11, the FD alignment and the CD alignment described above are performed with the second sheet S on the already-aligned first sheet S. The FD alignment and the CD alignment are repeated each time one sheet S is transported onto to the post-processing tray 11, until transport of the N number of sheets S is completed. In this way, a plurality of sheets S are stacked on the post-processing tray 11 in aligned state.

2. Transport to Stapling Position and Stapling

FIG. 5 is a schematic perspective view illustrating how the FD transport member 15 pushes a rear end of a sheet stack Sb composed of an N number of sheets S in the X direction and thereby transports the sheet stack Sb to the stapling position, after alignment of the sheets S of the sheet stack Sb on the post-processing tray 11.

First, the FD alignment member 14 returns to its home position and retracts under the sheet receiving surface of the post-processing tray 11. Further, the FD transport member 15 pushes the sheet stack Sb in the X direction to cause the sheet stack Sb to move to the stapling position. The distance that the FD transport member 15 travels for transporting the sheet stack Sb to the stapling position is determined in advance with reference to staple position information associating different sheet sizes and different distances.

Figure 6:
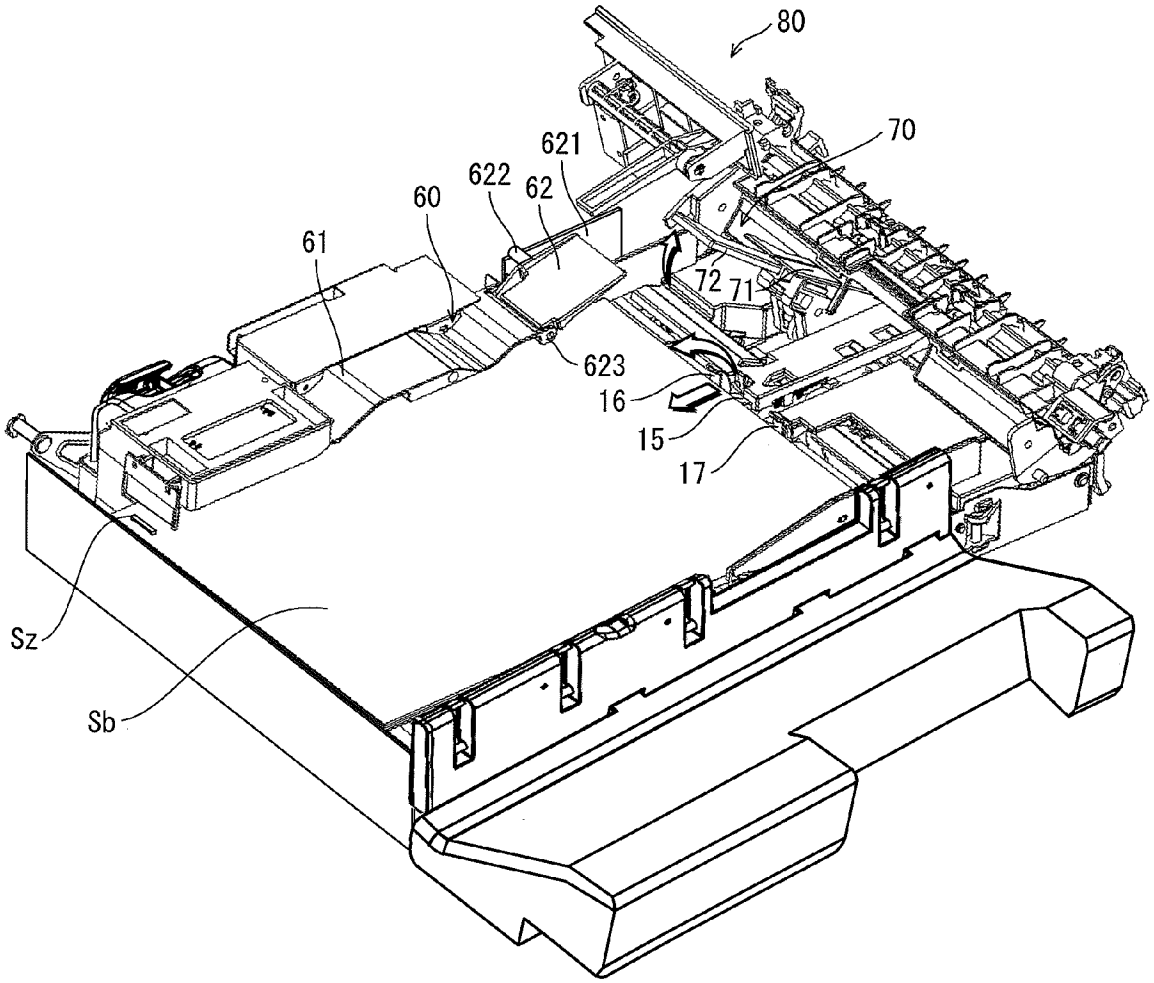
FIG. 6 is a schematic perspective view of a post-processing tray illustrating an FD transport member transporting a sheet stack to a transport position for transport to the front tray.

The FD transport member 15 comes to a halt when the sheet stack Sb arrives at the stapling position, and the stapler 103 performs stapling. When the stapling is completed, the FD transport member 15 transports the sheet stack Sb towards the transport position, as illustrated in FIG. 6. As already described above, this movement of the FD transport member 15 causes the guide base part 71 and the slide guide plate 72 of the second guide unit 70 to spring up.

Here, in order to maintain the sheet stack Sb in well-aligned state before and after transport to the stapling position, a configuration may be made such that the FD alignment member 14, instead of returning to its home position prior to the transport of the stapling position, may move along with the FD transport member 15 when the sheet stack Sb is transported to the stapling position, with the contact between the FD alignment member 14 and the leading end of the sheet stack Sb maintained. When making this configuration, the FD transport member 15 and the FD alignment member 14, together, transport the sheet stack Sb to the transport position after the stapling, until the FD alignment member 14 arrives at its home position. When arriving at its home position, the FD alignment member 14 retracts under the sheet receiving surface 22*a*. After the FD alignment member 14 retracts, the transport of the sheet stack Sb to the transport position is performed by the FD transport member 15 alone.

3. Pivot of Pivot Tray 22 to Horizontal State

When the transport of the sheet stack Sb to the transport position is completed, the entirety of the sheet stack Sb is on the pivot tray 22, as illustrated in FIG. 6.

Further, when the transport of the sheet stack Sb to the transport position is completed, the guide claws 16, 17 at the end portion 22*c* of the pivot tray 22, which is the end portion of the pivot tray 22 upstream in the sheet transport direction, switch to the protruding state from the retracted state. The guide claws 16, 17 in the protruding state prevent the sheet stack Sb on the pivot tray 22 in the inclined state from sliding towards the fixed tray 21 along the incline of the pivot tray 22.

Subsequently, the CD alignment plate 13 moves towards the device front side to return to its home position. Then, as illustrated in FIG. 9, the pivot tray 22 transitions to the horizontal state by the lift mechanism 220 (illustrated in FIG. 11) lifting the side of the pivot tray 22 including the end portion 22*c* about the pivot shaft 22*b*, which is located at the end portion of the pivot tray 22 that is downstream in the sheet transport direction.

The vertical-direction position of the pivot tray 22 in the horizontal state is determined in advance such that the entirety of a side edge 22*g* of the sheet receiving surface 22*a* at the device front side is higher than an upper end 53 of the upright wall portion 51*b*.

Note that the pivoting of the pivot tray 22 as described above causes the CD reference plate 12, the stapler 103, and the guide claws 16, 17 to pivot together with the pivot tray 22. Meanwhile, the CD alignment plate 13 and the CD reference plate 29, due to being supported by the fixed tray 21, do not pivot together with the pivot tray 22.

The relationship between the pivoting range of the pivot tray 22 in the vertical direction and the vertical height of the CD alignment plate 13 is also determined in advance such that an upper end 131 of the CD alignment plate 13 is lower in the vertical direction than the pivot tray 22.

Further, as already described above, when the pivot tray 22 is in the horizontal state, the side edge 22*g* of the sheet receiving surface 22*a* is higher than the upper end 53 of the upright wall portion 51*b*.

Further, when the pivot tray 22 transitions to the horizontal state, the engagement between the CD reference plate 12 and the CD reference plate 29 is released, which causes the CD reference plate 29 alone to return to its home position due to the biasing force of the tension spring connecting the CD reference plate 29 to the above-described portion of the device housing 100.

4. Transport to Front Tray 51

Figure 10:
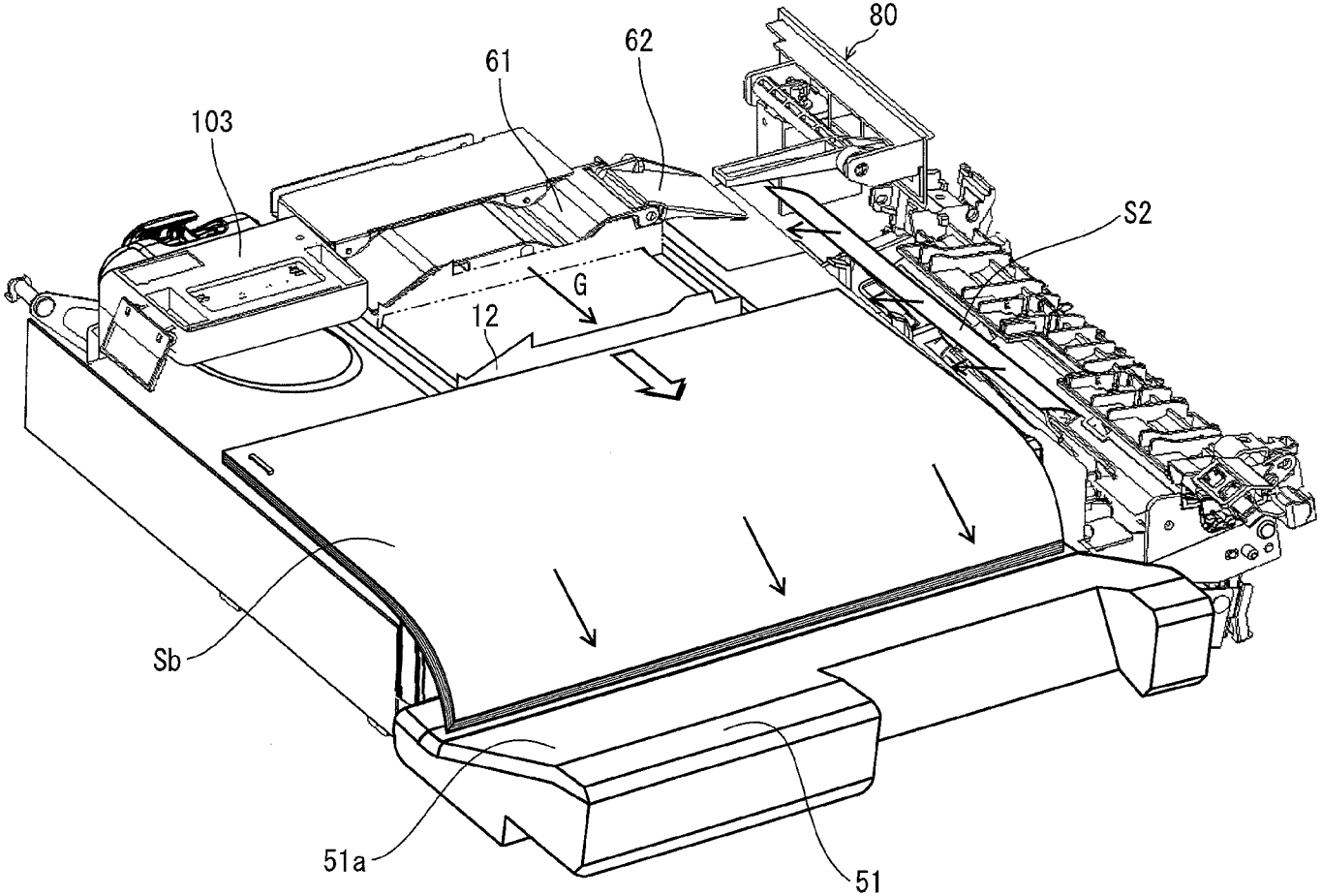
FIG. 10 is a perspective view illustrating transport of a sheet stack on the pivot tray to the front tray at a device front side.

When transition of the pivot tray 22 to the horizontal state is completed, the CD reference plate 12 moves from the device back side towards the device front side in the direction indicated by arrow G in FIG. 10. In this way, the sheet stack Sb on the pivot tray 22 in the horizontal state is transported towards the front tray 51, over the upper end 53 of the upright wall portion 51*b*.

When in the horizontal state, the pivot tray 22 is higher than the CD alignment plate 13. Thus, the CD alignment plate 13 does not interfere with the transport of the sheet stack Sb towards the device front side.

Figure 12:
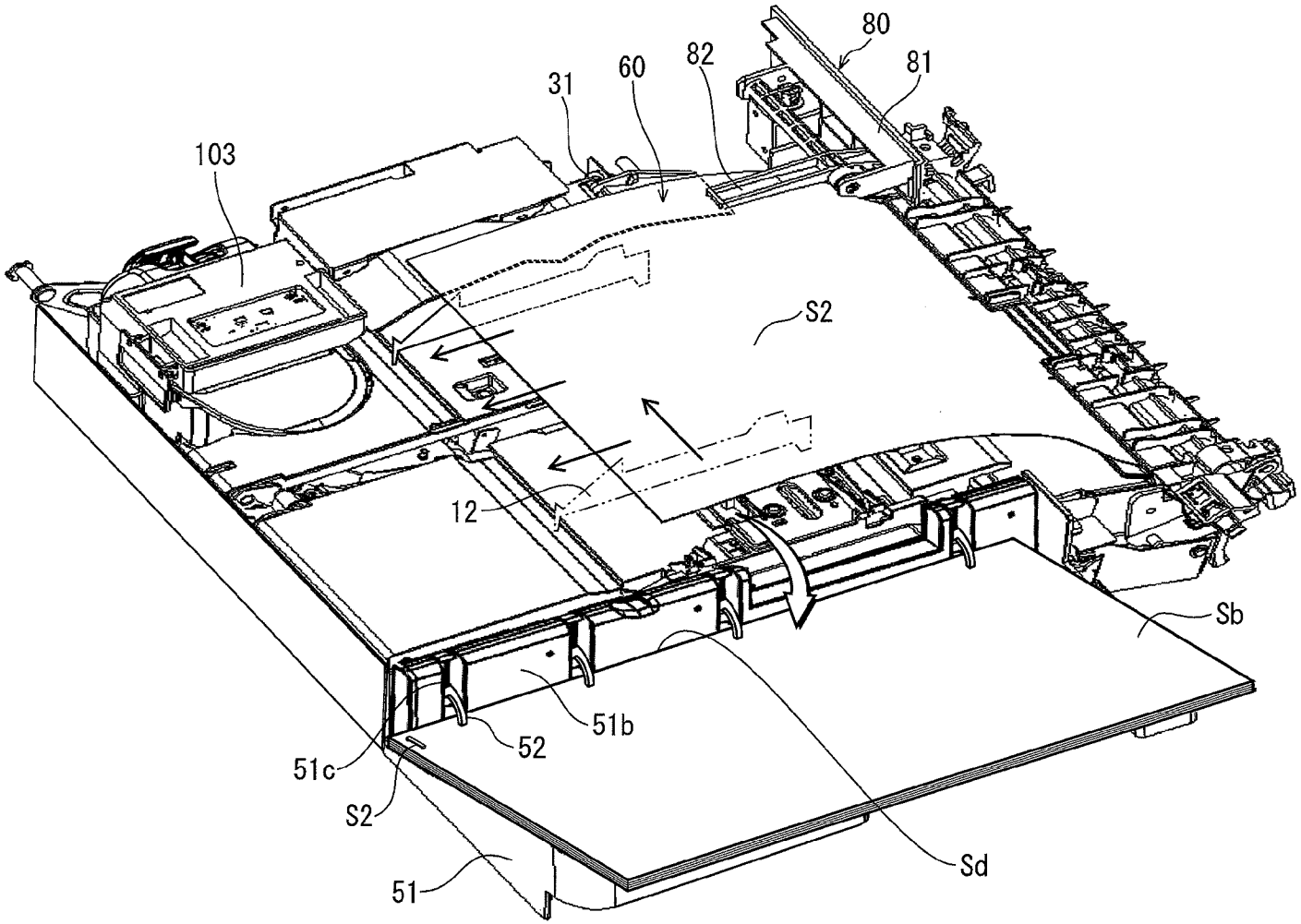
FIG. 12 is a perspective view illustrating ejection of a sheet belonging to a subsequent set of sheets after a CD reference plate transports a sheet stack to the front tray.

When the CD reference plate 12 arrives at a position closest to the device front side, the sheet stack Sb on the pivot tray 22 in the horizontal state is transferred to the front tray 51 to be placed on the sheet receiving surface 51*a*, as shown in FIG. 12.

The sheet stack Sb on the sheet receiving surface 51*a* slides towards the device back side along the incline of the sheet receiving surface 51*a*. The sliding of the sheet stack Sb stops when a side edge Sd of the sheet stack Sb at the device back side (i.e., a leading end of the sheet stack Sb in a slide direction) contacts the upright wall portion 51*b*, which is disposed at the device back side of the front tray 51.

In this way, the sheet stack Sb on the sheet receiving surface 51*a* stops with the side edge Sd in contact with the upright wall portion 51*b*.

Here, it suffices that the sheet stack Sb on the pivot tray 22 in the horizontal state can be transported to the sheet receiving surface 51*a* of the front tray 51 without being interfered by the upright wall portion 51*b*. Thus, the positional relationship of the sheet receiving surface 22*a* and the upper end 53 of the upright wall portion 51*b* may differ from that described above such that, for example, the side edge 22*g* of the sheet receiving surface 22*a* and the upper end 53 of the upright wall portion 51*b* are at the same level in the vertical direction.

Further, when a user specifies stapling multiple copies, the series of processes including the alignment of the sheet stack Sb, the stapling, the transition of the pivot tray 22 to the horizontal state, and the transport of the sheet stack Sb from the pivot tray 22 to the front tray 51 is executed for each copy, sequentially.

In such a case, when a sheet stack Sb corresponding to the first copy is placed on the front tray 51, the pressing claws 52 protrude from the respective cutout portions 51*c* to press down on and hold the sheet stack Sb corresponding to the first copy on the front tray 51, as illustrated in FIG. 12.

Subsequently, immediately before a sheet stack Sb corresponding to the second copy arrives at the front tray 51, the pressing claws 52 return to the initial retracted position (FIG. 3). The protruding and retracting of the pressing claws 52 is achieved by drive force of a pressing claw drive actuator 37 (illustrated in FIG. 15) that is composed of a solenoid, for example. In the present disclosure, when the pressing claw drive actuator 37 is driven, leading ends of the pressing claws 52 protrude from the upright wall portion 51*b* to press against the sheet stack Sb. Meanwhile, when the drive of the pressing claw drive actuator 37 is stopped, the pressing claws 52 return to the retracted position due to biasing force exerted by undepicted tension springs.

The present embodiment aims to suppress the reduction of productivity of the imaging forming device 1 as much as possible. Thus, a configuration is made such that ejection failures do not occur even when a sheet S2 belong to a subsequent sheet set is ejected onto the post-processing tray 11 while a first sheet stack Sb is being transported to the front tray 51. This is achieved by the second guide unit 70 and the first guide unit 60 guiding the sheet S2 upwards over the CD reference plate 12 moving to transport the first sheet stack Sb to the front tray 51.

Figure 11:
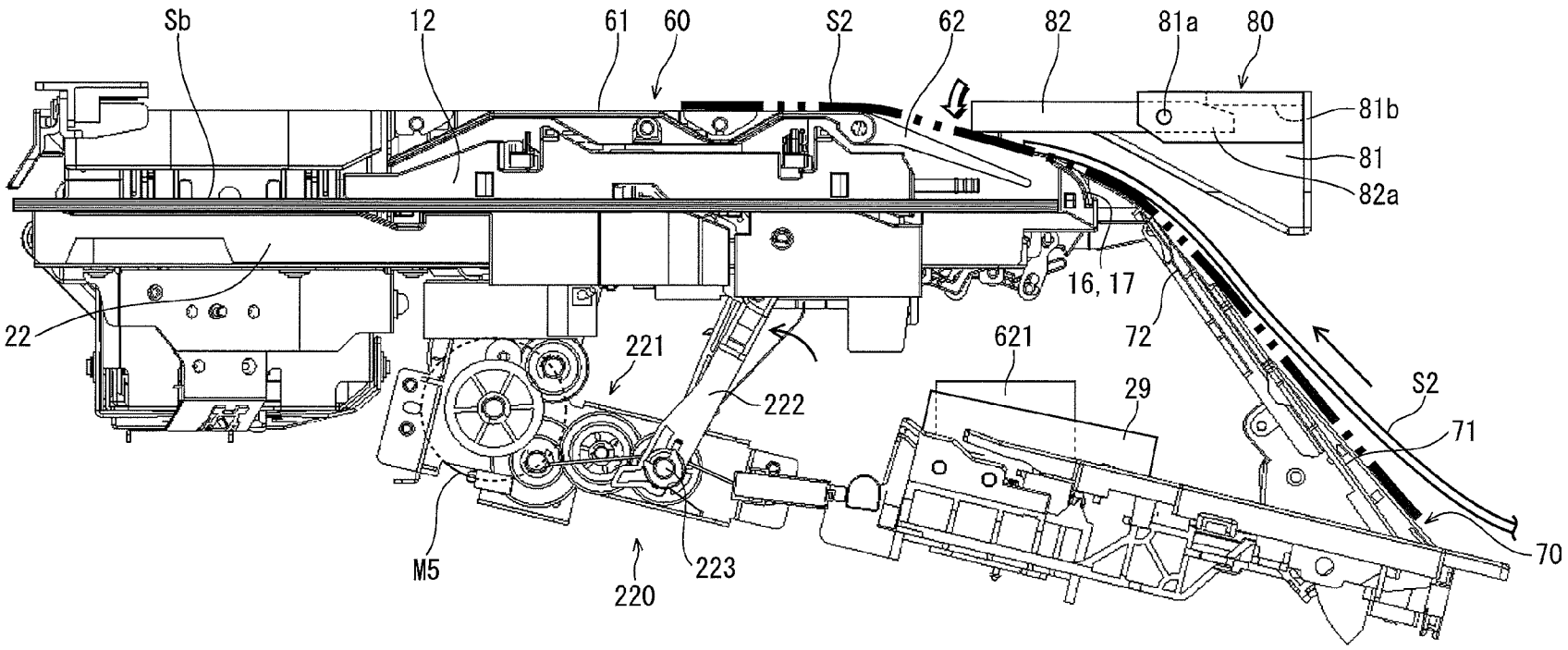
FIG. 11 is a schematic cross-sectional view of the post-processing tray illustrating a path along which a sheet guided by the second guide part travels when the pivot tray is in the horizontal state.

FIG. 11 is a schematic lateral view illustrating the post-processing tray 11 when the sheet S2 is being ejected as illustrated in FIG. 10.

The sheet S2 that is ejected from the image forming device 1 is guided obliquely upward by guide surfaces of the guide base part 71 and the slide guide plate 72 in the sprung-up state. In the present embodiment, the slide guide plate 72 is designed such that the leading end of the slide guide plate 72 projects to reach substantially the same height as the end portion of the pivot tray 22 in the horizontal state illustrated in the right side of FIG. 11.

The pressing guide member 80 includes a pressing guide main body 81 and a pressing arm 82. The pressing arm 82 is pivotably supported by the pressing guide main body 81 via a pivot shaft 81*a*, so as to be pivotable up and down.

An end portion 82*a* of the pressing arm 82 that is closer to the pressing guide main body 81 is in engagement with an engagement part 81*b* of the pressing guide main body 81. Thus, when the sheet S2 has not yet come in contact with the pressing arm 82, the pressing arm 82 is in the state illustrated in FIG. 11 (a substantially horizontal state in the present embodiment), without inclining downwards due to its own weight.

The sheet S2 is guided obliquely upwards by the guide base part 71 and the slide guide plate 72 to come in contact with the pressing arm 82, and then advances further while pushing the pressing arm 82 slightly upwards. Then, the sheet S2 arrives at the position indicated by the chain double-dashed line in FIG. 11 (i.e., the standby position), where the sheet S2 is in a state (referred to in the following as a standby state, illustrated in FIG. 12) where a portion thereof at the device back side is held on the upper surfaces of the guide plate main body 61 and the pivot guide plate 62.

When the sheet S2 is in the standby state, the pressing arm 82, due to its own weight, presses down on the upper surface of the sheet S2. This increases a pressure of contact and friction between the sheet S2 and the upper surfaces of the guide plate main body 61 and the pivot guide plate 62, a pressure of contact and friction between the sheet S2 and apex portions of the guide claws 16, 17, and a pressure of contact and friction between the sheet S2 and the guide surface of the second guide unit 70. Thus, the sheet S2 is highly stable at the standby position.

To achieve high stability of the sheet S2 at the standby position as described above, a counter-clockwise moment (with direction indicated by the arrow in FIG. 11) of the pressing arm 82 in its initial state, generated by its own weight, is set so that the sheet S2 can pass below the pressing arm 82 and so that the force pressing down on the sheet S2 at the standby position stabilizes the sheet S2 to such an extent that the sheet S2 does not move along with the CD reference plate 12 when the CD reference plate 12 moves. The weight and the shape of the pressing arm 82 are determined taking this into consideration. Meanwhile, biasing force of an elastic member such as a torsion spring may be utilized if appropriate. Further, configuration may be made such that pressing force necessary to achieve high stability of the sheet S2 as described above is applied by an appropriate actuator, such as a solenoid, each time a new sheet S2 arrives at the standby position.

Note that the pressing arm 82 may press down on the sheet S2 at any position, as long as the pressing by the pressing arm 82 increases at least one of (i) a pressure of contact between the sheet S2 and the upper guide surface of the first guide unit 60 and (ii) a pressure of contact between the sheet S2 and the guide surface of the second guide unit 70. This ensures a certain level of contact pressure with respect to the sheet S2.

Further, as illustrated in FIG. 12, while the CD reference plate 12 is moving to transport the sheet stack Sb, an end portion of the sheet S2 in the device back side is supported by the upper surfaces of the guide plate main body 61 and the pivot guide plate 62 to be prevented from falling, while the rest of the sheet S2 falls towards the CD reference plate 12 from above to come in contact with the upper end of the CD reference plate 12. Thus, ejection failures caused by a leading end of the sheet S2 slipping beneath the pivot tray 22 in the horizontal state or colliding with the end portion of the CD reference plate 12 that is upstream in the X direction are prevented. Further, since the pressing arm 82 presses down on the sheet S2, the sheet S2 is stable at the standby position. Thus, even if a part of a bottom surface of the sheet S2 comes in contact with the upper end of the CD reference plate 12 that is moving to transport the sheet stack Sb, the sheet S2 does not move along with the CD reference plate 12.

Figure 13:
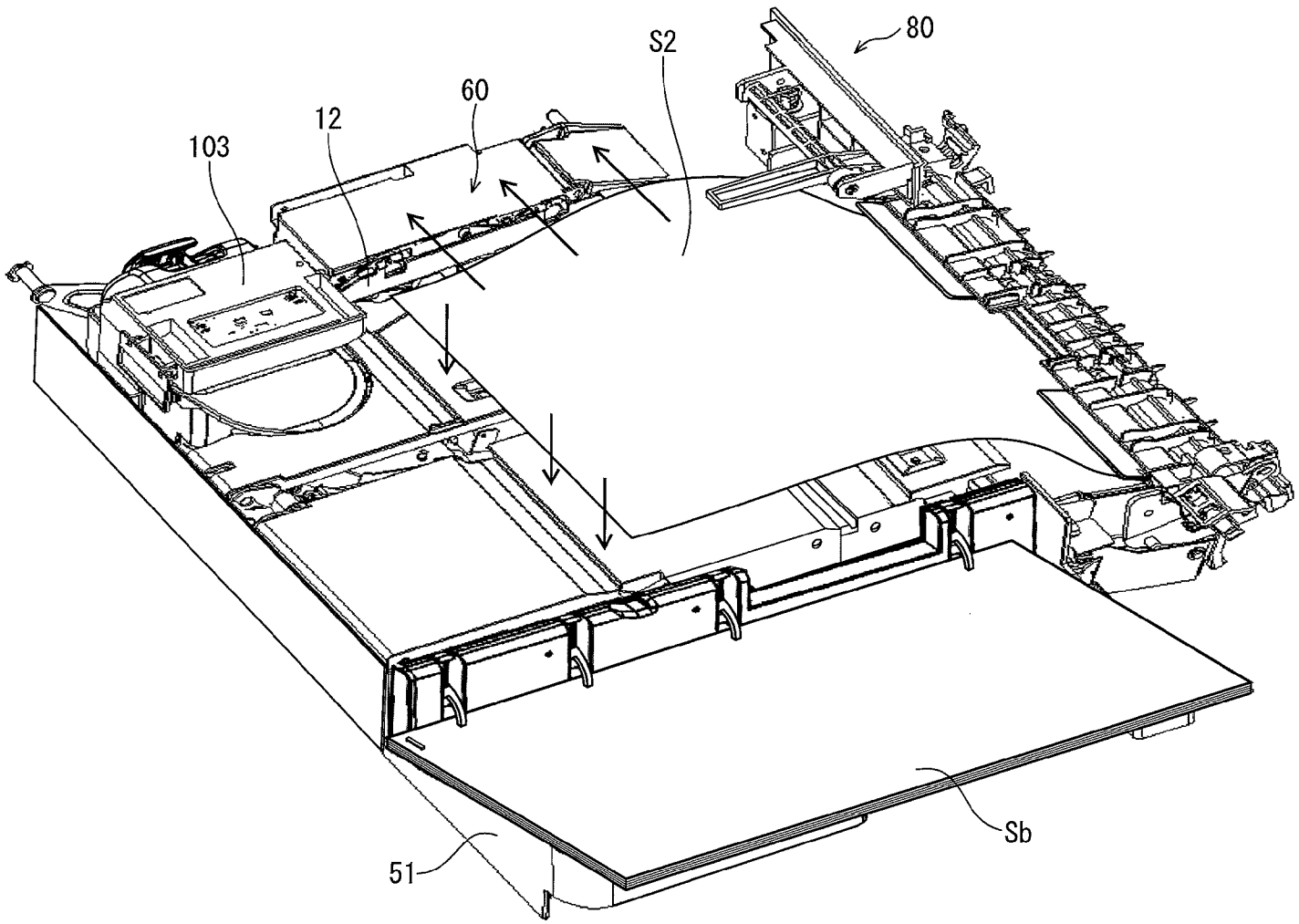
FIG. 13 illustrates, after a sheet stack is transported to the front tray and the CD reference plate returns to its home position, a guide main body of a first guide part retreating to its home position to cause a sheet thereon to fall on a sheet receiving surface of the pivot tray.
Figure 14:
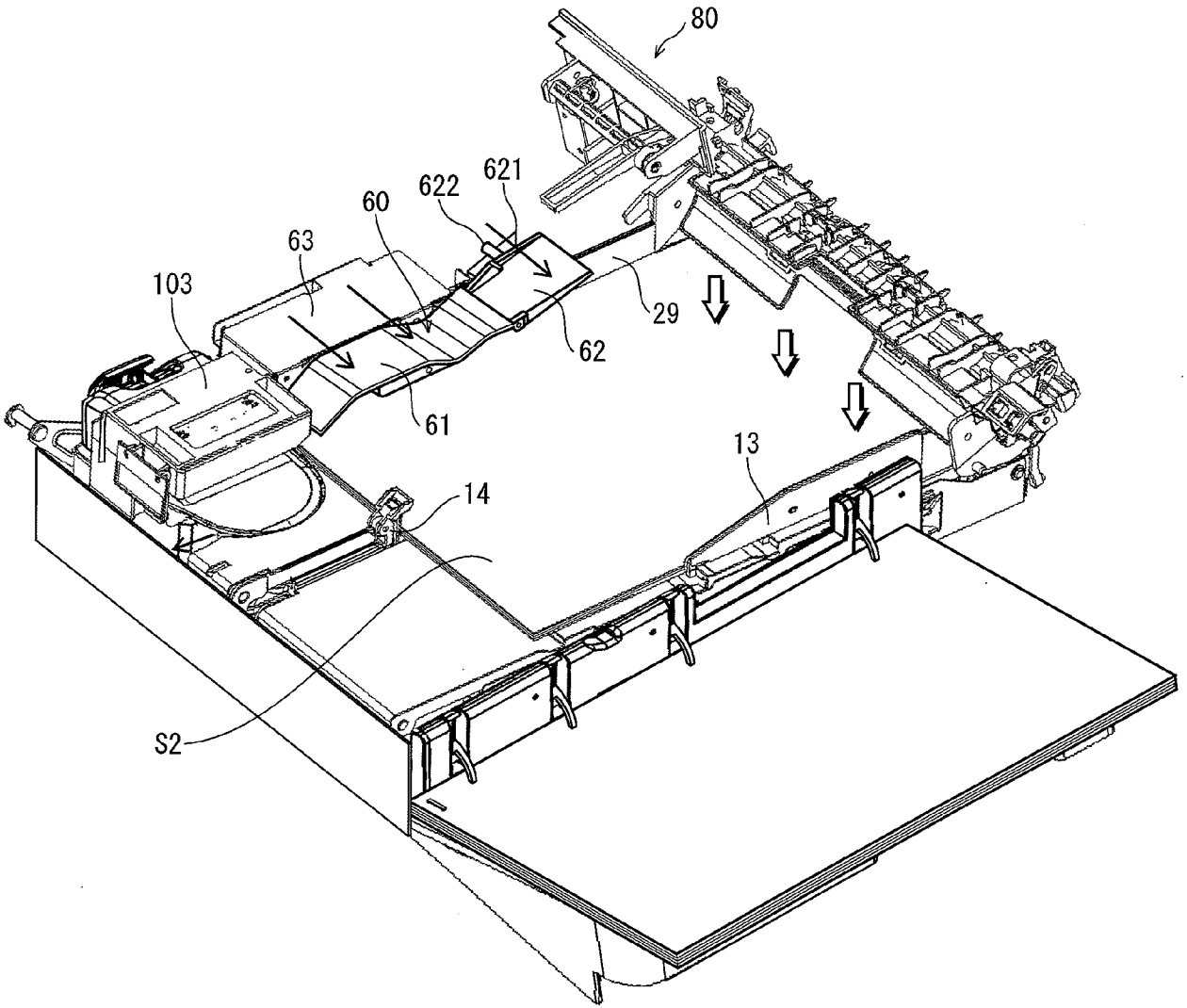
FIG. 14 is a schematic perspective view illustrating the post-processing tray after the pivot tray returns to the inclined state from the horizontal state.

As illustrated in FIG. 13, the guide plate main body 61 retreats to its home position when the CD reference plate 12 returns to its home position after the sheet stack Sb has been transported to the front tray 51 and there is no risk of the CD reference plate 12 interfering with subsequent sheets. Then, the sheet S2 in standby state is caused to fall on the sheet receiving surface 22*a* of the pivot tray 22. Further, the pivot tray 22 returns to the initial inclined state from the horizontal state (as illustrated in FIG. 14). When the pivot tray 22 returns to the inclined state, the FD transport member 15 also returns to its home position, which causes the second guide unit 70 to return to the retracted state.

Subsequently, FD alignment by the FD alignment member 14 and CD alignment by the CD alignment plate 13 are performed with respect to the sheet S2, and the guide plate main body 61 and the pivot guide plate 62 are driven to advance to the guide position.

When the pivot tray 22 returns to the inclined state, the pivot guide plate 62 returns to the state of being inclined relatively upwards with respect to the sheet receiving surface 22*a* due to the engagement pin 622 coming in contact with the upper end of the engagement member 621 once again. Thus, preparation for accepting the second and following sheets of the subsequent sheet set is completed.

When a sheet stack Sb corresponding to the second copy is transported to the front tray 51 and stacked on the sheet stack Sb corresponding to the first copy on the front tray 51, the four pressing claws 52 press down on and hold the two sheet stacks Sb. Following this, when subsequent copies are to be stapled, the above operations are repeated for each subsequent copy. Meanwhile, when the job is completed at this point, the pressing claws 52 return to the retracted position and the sheet stacks Sb on the front tray 51 are released from being held in pressed state. Here, note that the pressing claws 52 may be configured so that when one sheet stack Sb (i.e., one copy) is stapled, the pressing claws 52 return to the retracted position after pressing down on the sheet stack Sb. As a result, one or more stapled sheet stacks Sb are placed on the front tray 51 located at the device front side. Thus, the user can easily retrieve the one or more sheet stacks Sb on the front tray 51 from the device front side.

As described up to this point, the front tray 51 (second tray) is disposed at the device front side with respect to the post-processing tray 11 (first tray). Thus, device width is reduced compared to a conventional structure where a post-processing tray and a stack tray holding post-processed sheet stacks are disposed along the lateral direction in the device.

Further, even when the CD reference plate 12 (pushing member) move backs and forth to transport a set of a predetermined number of sheets on the post-processing tray 11 to the front tray 51, ejection of sheets of a subsequent sheet set can be continued without being suspended. This is achieved by the second guide unit 70 (direction changer) guiding at least each sheet of the subsequent sheet set ejected while the CD reference plate 12 is moving across the sheet receiving surface to change a travel direction of the at least each sheet from an ejection direction to an upward direction over the CD reference plate 12 moving across the sheet receiving surface, and in addition, by the first guide unit 60 supporting the at least each sheet guided upwards by the second guide unit 70.

As such, the image forming device 1 pertaining to the present embodiment has reduced size in the lateral direction, and is able to continue printing without delay even when a post-processed sheet stack Sb is being transported. Thus, the image forming device 1 has extremely high productivity.

The above describes an example where a job is executed of stapling a sheet stack Sb. However, the alignment of sheets of the sheet stack Sb, the transport to the pivot tray 22, transition of the pivot tray 22 to the horizontal state, and the transport of the sheet stack Sb to the front tray 51 are similarly performed when the job to be executed is, for example, a job in which printing is performed of a plurality of sheets, even when the job to be executed does not require stapling. When executing such jobs, the sheet post-processing device 2 serve as a sheet transport device.

Further, when the job to be executed is, for example, a job in which printing is performed of only one sheet S, ones of the processes described above other than the alignment of sheets the sheet stack Sb and the stapling, i.e., the transport to the pivot tray 22, transition of the pivot tray 22 to the horizontal state, and the transport to the front tray 51 are similarly performed.

<Control-Related Configuration of Image Forming Device 1 and Sheet Post-Processing Device 2>

Figure 15:
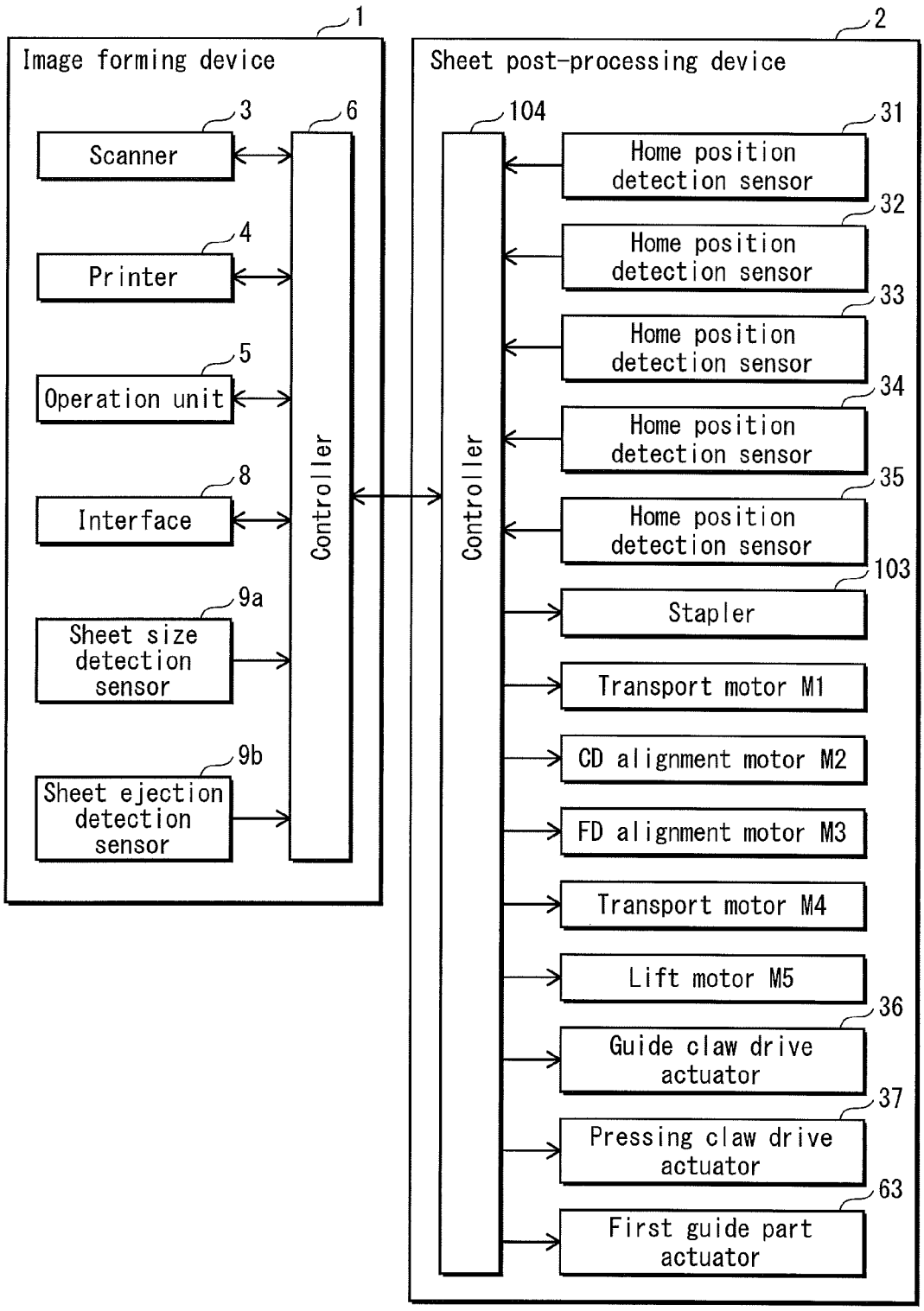
FIG. 15 illustrates the control-related configuration of the image forming device and the sheet post-processing device.

FIG. 15 is a block diagram for describing the control-related configuration of each of the image forming device 1 and the sheet post-processing device 2.

As illustrated in FIG. 15, the controller 6 of the image forming device 1 controls the scanner 3 and the printer 4 to perform scan jobs and copy jobs. Further, when the controller 6 receives data of a print job from an external terminal connected to a network via an external interface (I/F) 8, the controller 6 causes the printer 4 to execute the print job based on the data received.

Further, when the controller 6 receives an instruction to execute stapling from a user via the operation unit 5, the controller 6 transmits the number of sheets S to be stapled together (stapling sheet number), information specifying the number of copies, etc., to the controller 104 of the sheet post-processing device 2.

Further, the controller 6 receives a detection signal from a sheet size detection sensor 9*a* provided to the cassette 4*a* of the printer 4 and detects a sheet size and a transport orientation (longitudinal or transverse) of sheets S stored in the cassette 4*a*. The sheet size and the transport orientation detected by the sheet size detection sensor 9*a* are included in the sheet information transmitted to the controller 104 of the sheet post-processing device 2.

Further, when the controller 6 receives, from a sheet ejection sensor 9*b* (illustrated in FIG. 3) positioned near the ejection roller, a detection signal indicating detection of a sheet-transport-direction rear end (sheet rear end) of a sheet S ejected by the ejection roller, the controller 6 detects that a sheet S after printing has been ejected from the ejection roller. Each time ejection of one sheet S is detected, the controller 6 transmits a sheet ejection signal indicating ejection of one sheet S to the controller 104 of the sheet post-processing device 2.

The controller 104 of the sheet post-processing device 2 controls the stapler 103, the motors M1 through M5, the guide claw drive actuator 36, the pressing claw drive actuator 37, the actuator 63 of the first guide part 60, etc., to execute the alignment of sheets of the sheet stack Sb, the stapling, the transition of state of the pivot tray 22, the transport of the sheet stack Sb from the pivot tray 22 to the front tray 51, etc., as described above.

Further, the controller 104 receives a detection signal from a home position detection sensor 31 (illustrated in FIG. 12) for detecting that the CD reference plate 12 is at its home position, and detects whether or not the CD reference plate 12 is at its home position.

The home position detection sensor 31 is implemented by using, for example, a transmission-type optical sensor having an emitter and a receiver disposed with an interval therebetween.

The controller 104 may detect whether or not the CD reference plate 12 is at its home position by using methods other than the method described above. Further, home position detection sensors 32-35 described in the following may each detect whether or not a corresponding member is at its home position in a similar manner.

Further, the controller 104 receives a detection signal from the home position detection sensor 32 for detecting whether the CD alignment plate 13 is at its home position, in order to detect whether or not the CD alignment plate 13 is at its home position.

Further, the controller 104 receives a detection signal from the home position detection sensor 33 for detecting whether the FD alignment member 14 is at its home position, in order to detect whether or not the FD alignment member 14 is at its home position.

Further, the controller 104 receives a detection signal from the home position detection sensor 34 (refer to FIGS. 7A and 7B) for detecting whether the FD transport member 15 is at its home position, in order to detect whether or not the FD transport member 15 is at its home position.

Further, the controller 104 receives a detection signal from the home position detection sensor 35 for detecting whether the pivot tray 22 is in the inclined state (home position), in order to detect whether or not the pivot tray 22 is in its home position.

Further, the controller 104 can exchange data and information with the controller 6, and can acquire various types of information from the controller 6, such as an instruction to execute stapling received from a user, specification of a number of copies received from a user, and the sheet information detected by the image forming device 1.

<Contents of Control Executed by Controller 104 of Sheet Post-Processing Device 2>

Figure 16:
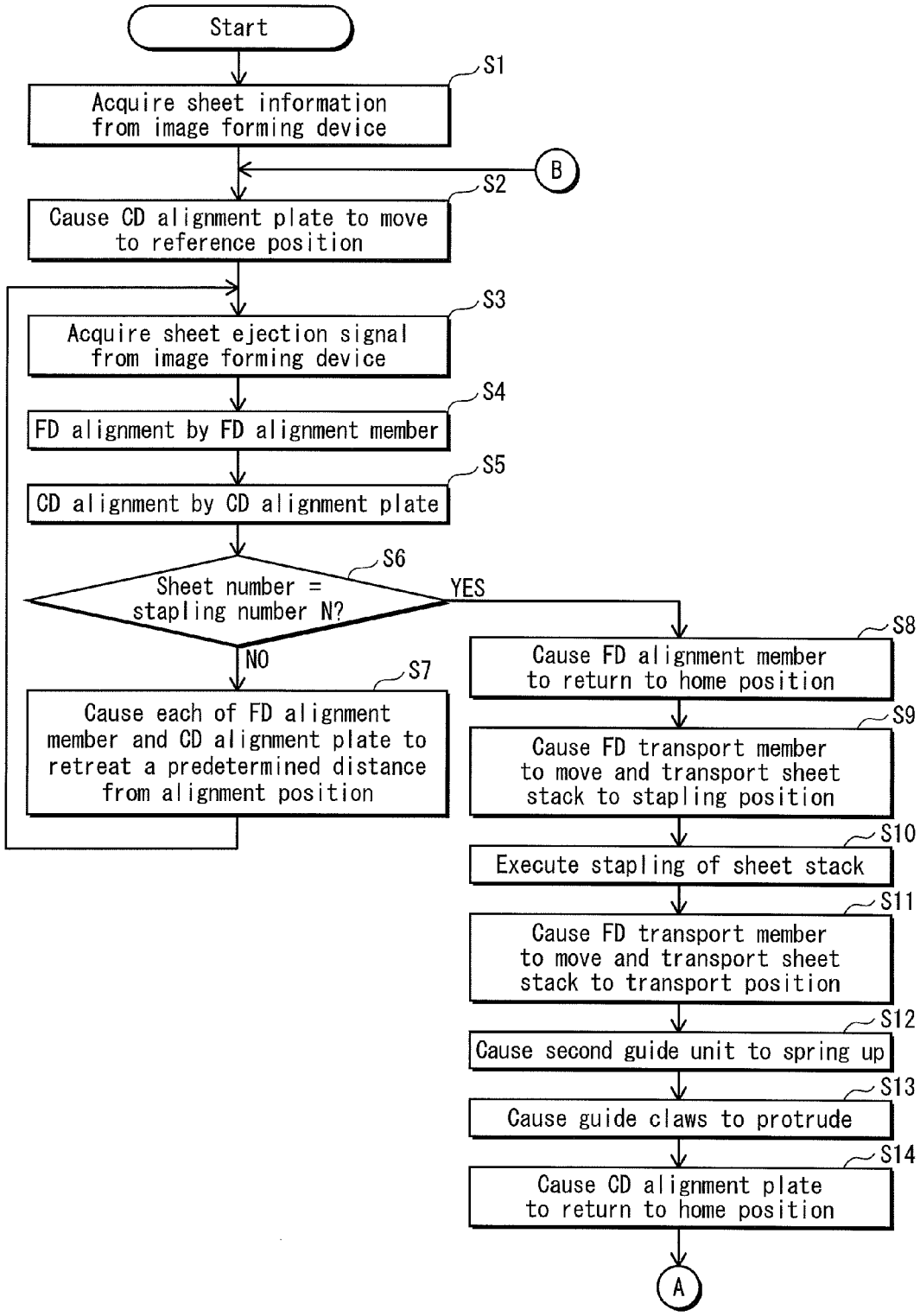
FIG. 16 is a flowchart illustrating stapling control executed by a controller of the sheet post-processing device.
Figure 17:
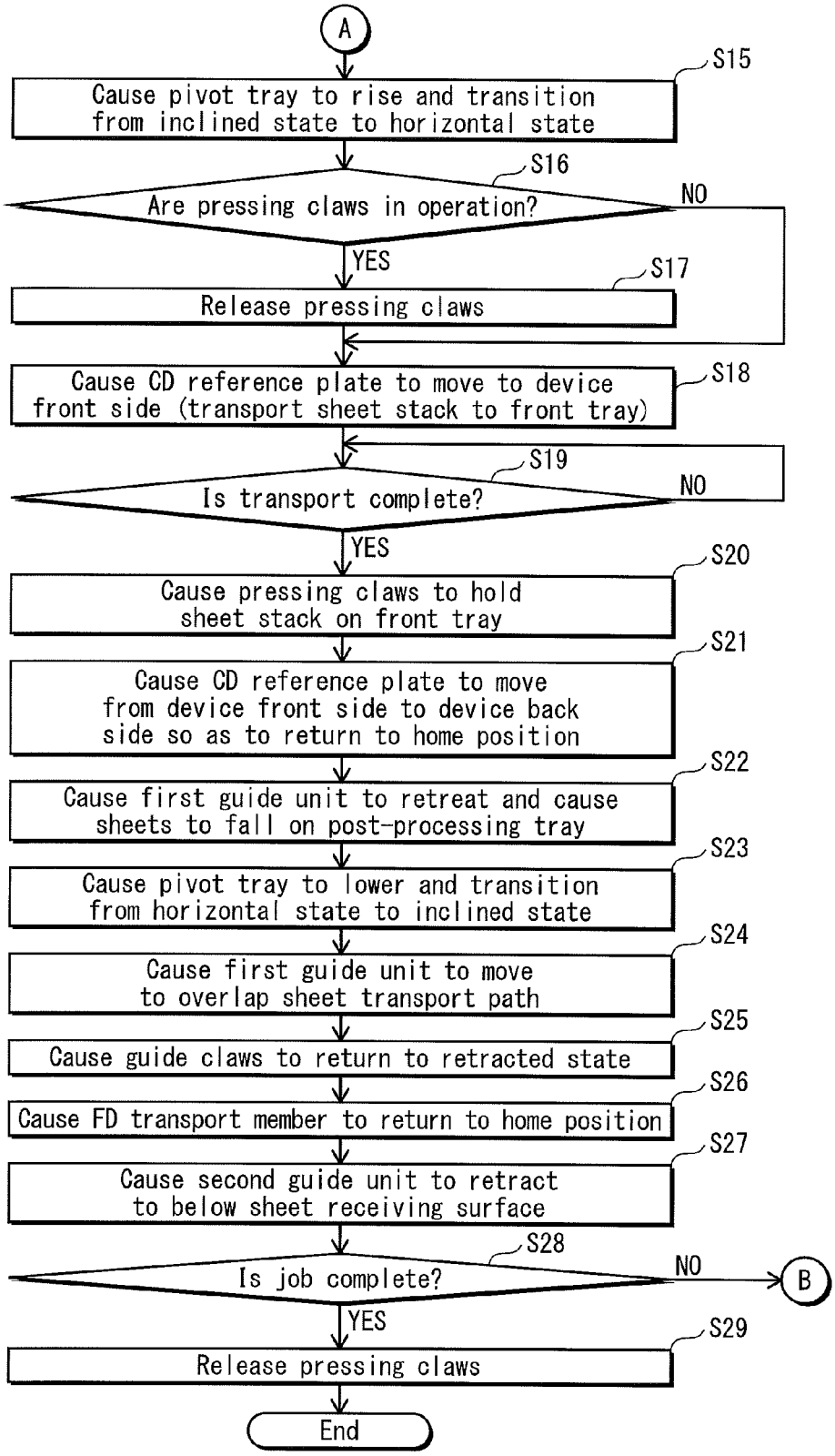
FIG. 17 is a flowchart illustrating processing following processing illustrated in the flowchart in FIG. 16.

FIG. 16 and FIG. 17 are flowcharts illustrating contents of control related to the transport and the stapling of the sheet stack Sb executed by the sheet post-processing device 2, executed when the controller 104 receives an instruction for stapling from the controller 6 of the image forming device 1.

As shown in FIG. 16, first, the controller 104 acquires the sheet information for sheets S to be ejected from the image forming device 1 (step S1).

Subsequently, the controller 104 causes the CD reference plate 12 to move from its home position to its reference position (step S2).

The controller 104 causes the CD reference plate 12 to move by causing the transport motor M4 to forward-drive by a predetermined number of revolutions/rotation angle. The predetermined number of revolutions/rotation angle corresponds to a predetermined distance from the home position of the CD reference plate 12 to the reference position of the CD reference plate 12. The movement of the CD reference plate 12 towards its reference position causes the CD reference plate 29 to move to its reference position along with the CD reference plate 12.

Subsequently, when acquiring a sheet ejection signal for a first sheet S from the image forming device 1 (step S3), the controller 104, regarding that the first sheet S has been transported onto the post-processing tray 11, causes the FD alignment member 14 to perform FD alignment (step S4) and then causes the CD alignment plate 13 to perform CD alignment (step S5).

Then, the controller 104 judges whether or not the number of sheets S ejected from the image forming device 1 (sheet number) has equaled the number N of sheets S to be stapled (stapling number) (step S6).

When judging that the number of sheets has not equaled the stapling number N ("NO" at step S6), the controller 104 causes both the FD alignment member 14 and the CD alignment plate 13 to retreat by a predetermined distance (10 mm in the above example) from their respective alignment positions towards their respective home positions (step S7), to wait for a next sheet S.

The controller 104 causes each of the FD alignment member 14 and the CD alignment plate 13 to retreat by a predetermined distance towards their respective home positions causing a corresponding one of the FD alignment motor M3 and the CD alignment motor M2 to reverse-drive by a number of revolutions/rotation angle corresponding to the predetermined distance.

When acquiring a sheet ejection signal for a second sheet S from the image forming device 1 (step S3), the controller 104 causes alignment with respect to the first sheet S and the second sheet S stacked thereon to be performed according to the processing of step S4 and step S5. Then, processing proceeds to step S6.

When the controller 104 once again judges that the number of sheets S has not equaled the stapling number N ("NO" at step S6), processing in step S7 and steps S3 to S6 is repeated. The processing in steps S3 to S7 are repeated until the controller 104 judges that the number of sheets S has equaled the stapling number N.

When judging that the number of sheets S has equaled the stapling number N ("YES" at step S6), the controller 104 causes the FD transport member 14 to move to its home position and retract below the sheet receiving surface (step S8). When the home position detection sensor 33 detects that the FD alignment member 14 is retracted, the controller 104 stops the FD alignment motor M3.

Subsequently, the controller 104 causes the FD transport member 15 to start moving for transport of a sheet stack Sb to the stapling position (step S9). Then, the controller 104 causes the stapler 103 to execute stapling of the sheet stack Sb (step S10).

After the stapling, the controller 104 causes the FD transport member 15 to start moving for transport of the sheet stack Sb towards the device front side to the transport position (step S11) (illustrated in FIG. 6).

The controller causes the FD transport member 15 to transport the sheet stack Sb to the transport position by causing the transport motor M1 to forward-rotate by a number of revolutions/rotation angle corresponding to the transport distance required for transporting the sheet stack Sb to the transport position.

The movement of the FD transport member 15 causes the guide base part 71 to spring up to a predetermined angle while the slide guide plate 72 projects forward (step S12).

Subsequently, the controller 104 causes the guide claws 16, 17 to switch from the retracted state to the protruding state (step S13) (FIG. 6). The controller 104 causes the guide claws 16, 17 to switch to the protruding state by causing the guide claw drive actuator 36 to drive.

Following this, the controller 104 causes the CD alignment plate 13 to return to its home position (step S14).

The controller 104 causes the CD alignment plate 13 to return to its home position by causing the CD alignment motor M2 to reverse-drive and causing the CD alignment motor M2 to stop when the home position detection sensor 32 detects the CD alignment plate 13.

Subsequently, processing proceeds to step S15 in FIG. 17, where the controller 104 causes the lift mechanism 220 to lift the pivot tray 22 so that the pivot tray 22 transitions from the inclined state to the horizontal state (illustrated in FIG. 9).

The controller 104 causes the pivot tray 22 to transition from the inclined state to the horizontal state by causing the lift motor M5 to forward-rotate by a predetermined number of revolutions/rotation angle required to cause the pivot tray 22 to transition from the inclined state to the horizontal state.

Note that the sequence of operations between step S8 and step S15 is preferably executed before a first sheet S2 belonging to a second sheet set is ejected toward the pivot tray 22 from the image forming device 1.

Subsequently, the controller 104 judges whether or not the four pressing claws 52*b* provided to the upright wall portion 51*b* are in operation, holding one or more previous sheet stacks Sb on the front tray 51 (step S16).

When judging that the pressing claws 52 are in operation ("YES" at step S16), the controller 104 causes the holding claws 52 to release the one or more previous sheet stacks (step S17), and then causes the CD reference plate 12 to move from the device back side towards the device front side for transport of the sheet stack Sb on the pivot tray 22 to the device front side (step S18).

When judging that the pressing claws 52 are not in operation ("NO" at step S16), the controller 104 skips step S17 and causes the sheet stack Sb to be transported to the front tray 51 (step S18).

The controller 104 causes the CD reference plate 12 to move from the device back side to the device front side by causing the transport motor M4 to forward-rotate by a number of revolutions/rotation angle corresponding to a predetermined transport distance between the reference position of the CD reference plate 12, which is at the device back side, to the position of the CD reference plate 12 all the way at the device front side.

When the controller 104 judges in step S19 that transport of the sheet stack Sb to the device front side has been completed due to the CD reference plate 12 moving all the way to the device front side ("YES" at step S19), the controller 104 causes the pressing claws 52 to hold the sheet stack Sb on the front tray 51, regarding that the sheet stack Sb has been placed on the front tray 51 (step S20) (illustrated in FIG. 12).

Subsequently, the controller 104 causes the CD reference plate 12 to move from the device front side to the device back side and return to its home position (step S21). The controller 104 causes the CD reference plate 12 to return to its home position by causing the transport motor M4 to reverse-rotate and stop when the home position detection sensor 31 detects the CD reference plate 12.

When the CD reference plate 12 has returned to its home position, the controller 104 causes the guide plate main body 61 and the pivot guide plate 62 to retreat to the home position (retreat position), thereby causing a sheet S2 of a subsequent sheet set to fall on the sheet receiving surface 22*a* of the pivot tray 22 (Step S22).

Here, the amount of time required for the pivot tray 22 to transition to the horizontal state, the amount of time required for the CD reference plate 12 to move back and forth to transport the sheet stack Sb to the front tray 51, etc., are determined in relation with the productivity of the image forming device 1 (i.e., the number of sheets printed by the image forming device 1 per unit time), such that the number of ejected sheets on the guide plate main body 61 when step S22 is executed is, for example, two or three sheets.

Subsequently, the controller 104 (i) lowers the end portion of the pivot tray 22 that is upstream in the sheet transport direction to cause the pivot tray 22 to transition from the horizontal state to the inclined state (step S23), (ii) causes the guide plate main body 61 to advance to overlap the sheet receiving surface (step S24), and (iii) causes the guide claws 16, 17 to return to the retracted state (step S25).

Further, the controller 104 causes the FD transport member 15 to return to its home position (step S26). This causes (i) the inclination angle of the guide base part 71 to return to its original angle, (ii) the slide guide plate 72 to return to the inside of the guide base part 71, and (iii) the second guide unit 70 to retract below the sheet receiving surface 21*a* of the fixed tray 21 (step S27).

Note that the sequence of operations between step S23 and step S27 is preferably executed substantially in parallel before a subsequent sheet ejected from the image forming device 1 arrives at the pivot tray 22.

Subsequently, the controller 104 judges whether or not the job has been completes (step S28). When the controller 104 judges that the job has not yet been completed ("NO" at step S28), processing returns to step S2 in FIG. 16 and processing from step S2 to step S28 is executed, in order to perform stapling with respect to a sheet stack Sb corresponding to a subsequent copy.

Until the controller 104 judges that the job has been completed, processing in steps S2 to S28 is repeated for each copy. When transport to the device front side of stapled sheet stacks Sb of all copies is completed, the controller 104 judges that the job has been completed ("YES" at step S28), and terminates control after causing the pressing claws 52 to release the sheet stacks Sb of all copies (step S29).

Figure 18A:
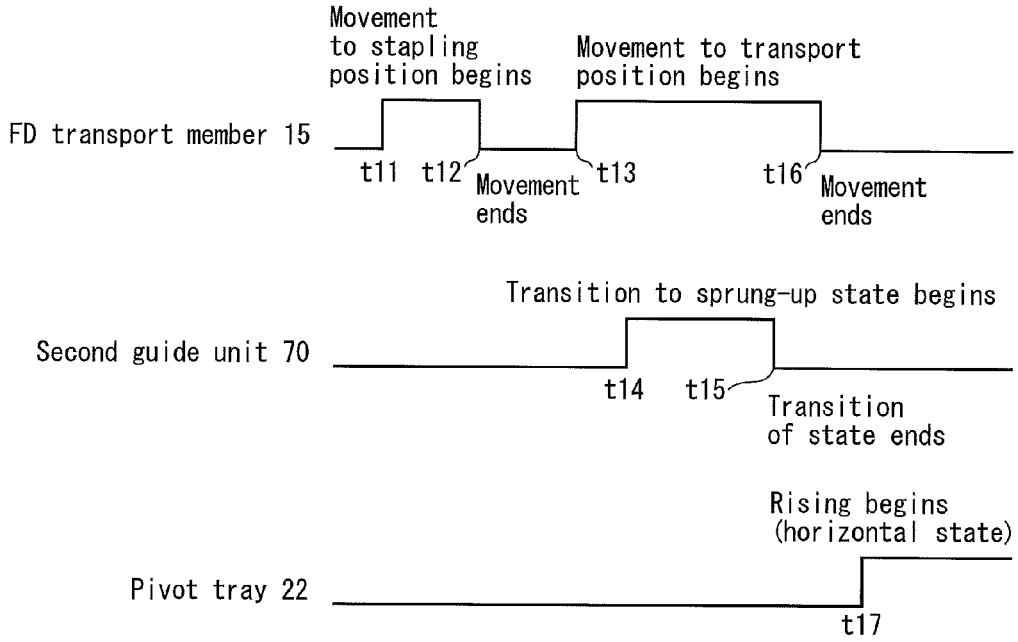
FIGS. 18A and 18B are sequences illustrating timings of operations by the FD transport member, the second guide part, and the pivot tray.
Figure 18B:
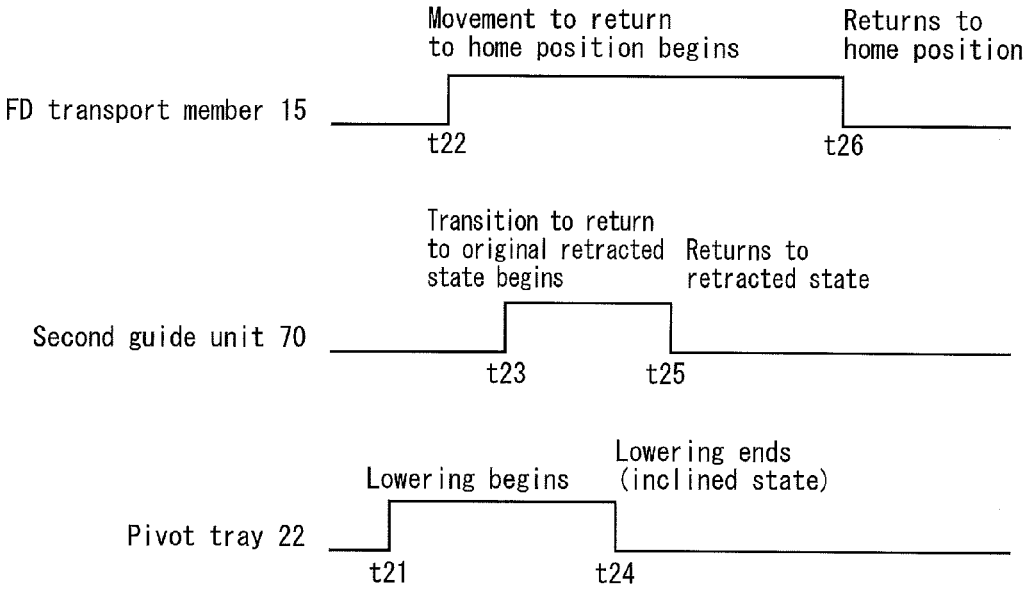

FIGS. 18A and 18B illustrate sequences indicating time points at which operations of the FD transport member 15, the second guide unit 70, and the pivot tray 22 are executed. Specifically, FIG. 18A illustrates a sequence before a sheet stack Sb is transported to the front tray 51, and FIG. 18B illustrates a sequence after the sheet stack Sb is transported to the front tray 51.

(a) Before Transport of Sheet Stack Sb to Front Tray 51

After alignment of the sheet stack Sb, the FD transport member 15 begins transporting the sheet stack Sb to the stapling position at time point t11. The transport of the sheet stack Sb to the stapling position is completed at time point t12. When the stapler 103 has stapled the sheet stack Sb, transport of the sheet stack Sb to the transport position is commenced at time point t13.

At time point t14, the movement of the FD transport member 15 activates the base part pivot mechanism 74, causes the guide base part 71 to begin pivoting to transition to the sprung-up state, and causes the slide guide plate 72 to project forward. The transition of the second guide unit 70 to the sprung-up state is completed at time point t15.

Subsequently, the transport of the sheet stack Sb to the transport position is completed at time point t16, and then lifting of the pivot tray 22 for transition to the horizontal state is commenced at time point t17. When a sheet is ejected from the image forming device 1 at this point, the second guide unit 70 guides the sheet upwards above the pivot tray 22 in the horizontal state and over the CD reference plate 12. Due to this, undesirable folding of the sheet, paper jams, etc., do not occur.

(b) After Transport of Sheet Stack Sb to Front Tray 51

First, the lowering of the pivot tray 22 beings at time point t21. Subsequently, the FD transport member 15 begins to return to its home position at time point t22. The movement of the FD transport member 15 to its home position causes the second guide unit 70 to return to its original retracted state at time point t23.

Subsequently, the lowering of the pivot tray 22 is completed and the pivot tray 22 returns to its original inclined state at time point t24. Following this, after the second guide unit 70 finishes retracting below the fixed tray 21 at time point t25, the FD transport member 15 returns to its home position at time point t26.

As described up to this point, according to the present embodiment, in the sheet post-processing device 2 mounted in the space 1*a* between the scanner 3 and the printer 4 of the image forming device 1, a sheet stack Sb composed of one or more sheets S ejected from the image forming device 1 is temporarily stored on the post-processing tray 11 at the device back side. Subsequently, after being transported to a post-processing position, the sheet stack Sb is transported from the device back side to the device front side to be placed on to the front tray 51 disposed at the device front side with respect to the post-processing tray 11. This configuration reduces device dimensions in the lateral direction. Further, while the sheet stack Sb on the post-processing tray 11 is being transported to the front tray 51, the second guide unit 70 guides subsequent sheets, which prevents the CD reference plate 12 transporting the sheet stack Sb to the front tray 51 from interfering with the ejection of the subsequent sheets. Thus, the sheet post-processing device 2 can perform post-processing continuously without productivity of the image forming device 1 being reduced.

The technology pertaining to the present disclosure is not limited to being applicable to a sheet post-processing device. That is, the technology is applicable to a sheet transport device if not a sheet post-processing device, and is applicable to an image forming system that is a combination of an image forming device and the sheet post-processing device or the sheet transport device.

<Modifications>

Up to this point, description has been provided of the technology pertaining to the present disclosure based on one embodiment. However, the technology is not limited to the above embodiment, and modifications such as those described in the following may be made.

(1) In the embodiment, the actuator 63 causes the guide plate main body 61 to move between the home position (retreat position) and the guide position (advance position) above the sheet receiving surface 22*a*. However, other structures are also applicable.

For example, a modification may be made such that the guide plate main body 61 is held so as to be slidable between the home position and the guide position, the guide plate main body 61 is biased towards the guide position by a biasing means such as a compression spring, and the guide plate main body 61 retreats by engaging with the CD reference plate 12 when the CD reference plate 12 moves further towards the device back side from its home position. Such a structure renders unnecessary the actuator 63 (i.e., an actuator dedicated to the first guide unit 60), and achieves a reduction in cost.

(2) The first guide unit 60 is not always necessary. The ejection failures described above occur when a leading end of a sheet S collides with an end portion of the pivot tray 22 in the horizontal state, an end portion of the CD reference plate 12, etc., while a sheet stack Sb on the pivot tray 22 is being transported to the front tray 51. As such, even if the first guide unit 60 were not included, as long as the second guide unit 70 guided the sheet S to travel upwards above such obstacles, such ejection failures would not occur.

(3) In the embodiment, the operation of the second guide unit 70 of putting a guiding plate in sprung-up state and guiding a sheet to travel in a direction different from the direction in which the sheet is ejected is executed mechanically by the guide extension mechanism 73, the guide base part pivot mechanism 74, etc., accompanying movement of the FD transport member 15 moves. However, this may be modified.

For example, the guide extension mechanism 73, the guide base part pivot mechanism 74, etc., may each be provided with a dedicated actuator, a dedicated drive source, or the like, which is caused to operate at the timings explained with reference to FIGS. 16, 17, 18A, and 18B.

(4) In the embodiment, retrieval of a sheet stack Sb from the device front side is facilitated and the size of the image forming device in the lateral direction is reduced by providing the front tray 51 at the device front side with respect to the post-processing tray 11 and by transporting a stapled sheet stack Sb to the front tray 51. Reduction of device size in the lateral direction can be achieved as long as the front tray 51 is disposed in a direction intersecting with the direction in which sheets S are ejected onto the post-processing tray 11 with respect to the post-processing tray 11.

(5) In the embodiment, in its initial state, the sheet receiving surface of the post-processing tray 11 is inclined so that an end portion of the sheet receiving surface in the direction of the ejection roller of the image forming device 1 (an end portion that is upstream in the sheet transport direction) is lower than the other end portion. This structure causes sheets S ejected from the ejection roller to slide on the sheet receiving surface of the post-processing tray 11 so that the rear ends of the sheets S contact the stoppers 18*a*, 18*b*. This structure achieves an advantageous effect that FD alignment is easily performed by causing the FD alignment member 14, which is disposed downstream in the sheet transport direction, to come in contact with the leading end portion of a sheet stack Sb.

However, for example, instead of the pivot tray 22, a horizontal tray that is movable up and down relative to the front tray 51 while maintaining a horizontal orientation may be provided, if appropriate.

(6) In the embodiment, an example is described in which the image forming device 1 is a multifunction device. However, as long as the image forming device is provided with the scanner 3 (image reader), the printer 4 (image former) below the scanner 3, and the space 1*a* therebetween, at least part of which defining the opening 1*b* at the device front side, the image forming device may be, for example, a copy machine, a facsimile machine, etc.

Further, in the embodiment, as the sheet post-processing device 2 mounted in the space 1*a* of the image forming device 1, description is provided while taking a sheet post-processing device that can execute a stapling function as an example. However, post-processing that the sheet post-processing device executes is not limited to stapling, and the sheet post-processing device may, for example, perform a binding process or a punching process for punching holes in a sheet stack on the post-processing tray 11.

Further, the shape, the number, etc., of each element described above such as the CD reference plate 12, the FD alignment member 14, etc., are not limited to those described above, and may be determined as appropriate for the device.

Further, a sheet post-processing device may be regarded as a sheet transport device having a post-processing device disposed along a sheet transport path. As such, a sheet transport device can be construed as being a device of a superordinate concept, encompassing a sheet post-processing device.

As such, the technology pertaining to the present disclosure, without means for post-processing, is applicable to a sheet transfer device, and in such a case, the technology pertaining to the present disclosure achieves an advantageous effect of temporarily placing sheets ejected from another device on a first tray and continuously transporting sheets from the first tray to a second tray that is disposed, with respect to the first tray, in a direction other than a direction in which the sheets are ejected onto the first tray.

Further, various combinations are possible of what is disclosed in the embodiment and what is disclosed in the modifications.

Although the technology pertaining to the present disclosure has been fully described by way of examples with reference to the accompanying drawings, it is to be noted that various changes and modifications will be apparent to those skilled in the art.

Therefore, unless such changes and modifications depart from the scope of the present disclosure, they should be construed as being included therein.

What is claimed is:

1. A sheet transport device comprising:

a first tray having a sheet receiving area on which sheets ejected in a first direction from an ejector are placed, wherein at least a part of the first tray is movable up and down;

a second tray being positioned in a second direction with respect to the first tray, the second direction intersecting the first direction;

a transporter configured to cause a pushing member to move back and forth between a first position and a second position each at one side of the sheet receiving area along the second direction, the second position closer to the second tray than the first position, wherein when a first sheet set composed of a predetermined number of sheets is ejected onto the first tray, the transporter transports the first sheet set to the second tray by putting the pushing member in contact with an end of the first sheet set facing the first position and causing the pushing member to move from the first position to the second position; and a direction changer configured to cause a guide member to guide, in a second sheet set, at least a sheet ejected while the pushing member is moving across the sheet receiving area and to change a direction in which the sheet travels to an upward direction over the pushing member by putting the guide member in a predetermined angle with respect to a horizontal direction, the second sheet set ejected subsequent to the first sheet set and being composed of sheets of the predetermined number;

wherein the first tray is switchable between a first state and a second state, wherein in the first state, the first tray is inclined with an end portion thereof that is upstream in the first direction lower than an end portion thereof that is downstream in the first direction, and in the second state, the end portion that is upstream in the first direction is higher than in the first state, the transporter causes the pushing member to push the first sheet set towards the second tray when the first tray is in the second state, and the predetermined angle of the guide member is set so that, when the first tray is in the second state, the sheet does not collide with the pushing member moving across the sheet receiving area.

2. The sheet transport device of claim 1, wherein the direction changer includes a guide member extender that causes the guide member to extend in the upward direction when the guide member is put in the predetermined angle.

3. The sheet transport device of claim 1, wherein the direction changer includes a retractor that causes the guide member to retract to a position where the guide member does not affect the direction in which the sheet travels.

4. The sheet transport device of claim 1 further comprising a post-processor that performs post-processing with respect to the first sheet set on the first tray, wherein the first sheet set is transported to the second tray after the post-processing is completed.

5. The sheet transport device of claim 1, wherein the predetermined angle of the guide member corresponds to a position of said at least a part of the first tray in a direction in which said at least part of the first tray moves up and down.

6. A sheet transport device comprising:

a first tray having a sheet receiving area on which sheets ejected in a first direction from an ejector are placed, wherein at least a part of the first tray is movable up and down;

a second tray being positioned in a second direction with respect to the first tray, the second direction intersecting the first direction;

a transporter configured to cause a pushing member to move back and forth between a first position and a second position each at one side of the sheet receiving area along the second direction, the second position closer to the second tray than the first position, wherein when a first sheet set composed of a predetermined number of sheets is ejected onto the first tray, the transporter transports the first sheet set to the second tray by putting the pushing member in contact with an end of the first sheet set facing the first position and causing the pushing member to move from the first position to the second position;

a direction changer configured to cause a guide member to guide, in a second sheet set, at least a sheet ejected while the pushing member is moving across the sheet receiving area and to change a direction in which the sheet travels to an upward direction over the pushing member by putting the guide member in a predetermined angle with respect to a horizontal direction, the second sheet set ejected subsequent to the first sheet set and being composed of sheets of the predetermined number; and a supporter configured to cause a support member to support the sheet after the sheet is guided in the upward direction such that at least a part of the sheet does not come in contact with the pushing member.

7. The sheet transport device of claim 6 further comprising a sheet presser configured to press down on the sheet after the sheet is guided in the upward direction to increase at least one of (i) a pressure of contact between the sheet and a surface of the supporting member that supports the sheet and (ii) a pressure of contact between the sheet and a surface of the guide member that comes in contact with the sheet.

8. The sheet transport device of claim 6, wherein after the pushing member completes transport of the first sheet set to the second tray and returns to the first position, the supporter causes the supporting member to retreat, thereby causing the sheet to fall on the first tray.

9. An image forming system comprising an image forming device forming images on sheets and a sheet transport device transporting sheets ejected from the image forming device, wherein the sheet transport device includes:

a first tray having a sheet receiving area on which the sheets ejected in a first direction from the image forming device are placed, wherein at least a part of the first tray is movable up and down;

a second tray being positioned in a second direction with respect to the first tray, the second direction intersecting the first direction;

a transporter configured to cause a pushing member to move back and forth between a first position and a second position each at one side of the sheet receiving area along the second direction, the second position closer to the second tray than the first position, wherein when a first sheet set composed of a predetermined number of sheets is ejected onto the first tray, the transporter transports the first sheet set to the second tray by putting the pushing member in contact with an end of the first sheet set facing the first position and causing the pushing member to move from the first position to the second position; and a direction changer configured to cause a guide member to guide, in a second sheet set, at least a sheet ejected while the pushing member is moving across the sheet receiving area and to change a direction in which the sheet travels to an upward direction over the pushing member by putting the guide member in a predetermined angle with respect to a horizontal direction, the second sheet set ejected subsequent to the first sheet set and being composed of sheets of the predetermined number;

wherein the image forming device includes an image reader and an image former disposed below the image reader and partly separated from the image reader by a space, at least part of the space defining an opening at a front side of the image forming device, and the sheet transport device is mounted in the space with the second tray at the front side of the image forming device.

10. The image forming system of claim 9, wherein the predetermined angle of the guide member corresponds to a position of said at least a part of the first tray in a direction in which said at least part of the first tray moves up and down.

* * * * *